US008011654B2

(12) United States Patent
Hayashi

(10) Patent No.: US 8,011,654 B2
(45) Date of Patent: Sep. 6, 2011

(54) SHEET STACKING APPARATUS AND IMAGE FORMING APPARATUS

(75) Inventor: Kenichi Hayashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 13 days.

(21) Appl. No.: 11/868,016

(22) Filed: Oct. 5, 2007

(65) Prior Publication Data

US 2008/0099983 A1 May 1, 2008

(30) Foreign Application Priority Data

Oct. 31, 2006 (JP) ..... 2006-297134

(51) Int. Cl.
*B65H 31/36* (2006.01)

(52) U.S. Cl. ..... 271/221; 271/223; 271/224; 271/236; 271/239

(58) Field of Classification Search ..... 271/221, 271/223, 224, 236, 239, 234, 238, 240
See application file for complete search history.

(56) References Cited

U.S. PATENT DOCUMENTS

| | | | | |
|---|---|---|---|---|
| 5,251,889 | A * | 10/1993 | Spencer et al. | 271/171 |
| 5,368,288 | A * | 11/1994 | Philipp et al. | 271/215 |
| 5,613,673 | A * | 3/1997 | Roberts et al. | 271/182 |
| 5,634,634 | A * | 6/1997 | Dobbertin et al. | 271/3.02 |
| 6,044,246 | A | 3/2000 | Tashiro et al. | 399/410 |
| 6,073,925 | A * | 6/2000 | Sato | 271/171 |
| 6,102,385 | A * | 8/2000 | Wakamatsu et al. | 270/58.12 |
| 6,257,571 | B1 * | 7/2001 | Kniss et al. | 271/181 |
| 6,305,281 | B1 * | 10/2001 | Aizawa | 101/118 |
| 6,523,822 | B1 * | 2/2003 | Galtier et al. | 271/171 |
| 6,991,229 | B2 * | 1/2006 | Yamakawa et al. | 271/223 |
| 6,994,339 | B2 * | 2/2006 | Kato et al. | 270/58.12 |
| 7,017,901 | B2 * | 3/2006 | Shiraishi et al. | 271/220 |
| 7,192,020 | B2 | 3/2007 | Hayashi et al. | 270/58.11 |
| 7,318,584 | B2 * | 1/2008 | Kato et al. | 270/58.11 |
| 7,537,209 | B2 * | 5/2009 | Kato et al. | 271/220 |

(Continued)

FOREIGN PATENT DOCUMENTS

JP 11-228033 8/1999

OTHER PUBLICATIONS

European Search Report issued by the European Patent Office, on Feb. 5, 2008, in European Patent Application No. 07119800.6.

*Primary Examiner* — Patrick H. Mackey
*Assistant Examiner* — Prasad V Gokhale
(74) *Attorney, Agent, or Firm* — Fitzpatrick, Cella, Harper & Scinto

(57) ABSTRACT

An image forming apparatus includes a sheet stacking apparatus including: a sheet stacking portion on which a sheet is stacked; a sheet conveying portion which conveys the sheet onto the sheet stacking portion; a first aligning member moving along a sheet conveying direction to align the position of the sheet stacked on the sheet stacking portion; and second aligning members which move in a width direction crossing the sheet conveying direction to align the position in the width direction of the sheet stacked on the sheet stacking portion, wherein the second aligning members align the sheet stacked on the sheet stacking portion, and the first aligning member aligns the sheet aligned by the second aligning member, and the sheet conveying portion conveys the next sheet onto the sheet stacking portion while the first aligning member is moving for aligning the sheet.

6 Claims, 17 Drawing Sheets

U.S. PATENT DOCUMENTS

| | | | | |
|---|---|---|---|---|
| 2003/0160376 | A1 * | 8/2003 | Yamada et al. | 270/58.07 |
| 2005/0179190 | A1 | 8/2005 | Kamiya et al. | 270/58.07 |
| 2006/0012099 | A1 | 1/2006 | Kaneko | 270/37 |
| 2006/0017209 | A1 | 1/2006 | Kushida et al. | 270/37 |
| 2006/0120784 | A1 * | 6/2006 | Iida et al. | 399/407 |
| 2007/0102860 | A1 | 5/2007 | Hayashi et al. | 270/58.11 |
| 2007/0108690 | A1 | 5/2007 | Hayashi et al. | 270/58.27 |

* cited by examiner

SHEET STACKING APPARATUS AND IMAGE FORMING APPARATUS

BACKGROUND OF THE INVENTION

1. Field of the Invention

The present invention relates to a sheet stacking apparatus and an image forming apparatus.

2. Description of the Related Art

A sheet stacking apparatus is known in which by aligning sheets that are stacked on a sheet stacking portion by a side aligning member, the alignment in a width direction crossing a conveying direction of the sheet is improved. Due to the fact that alignment processing is conducted by the side aligning member so as to align sheet edge portions in the width direction every time a sheet is stacked, the aligned state of sheets P on the sheet stacking portion is improved.

However, in such a conventional sheet stacking apparatus, an aligning operation with respect to sheets that are stacked on the sheet stacking portion is to be conducted only with respect to the width direction of the sheets, so that misalignment in the sheet conveying (discharging) direction cannot be corrected. To further improve the alignment of the stacked sheets, the alignment in the sheet conveying direction needs to be done in addition to that in the width direction.

Here, to correct a misalignment in the sheet conveying direction of the sheet, for example, it is conceivable that a leading edge stopper configured to control a leading edge position of the sheet having been stacked, as is a side aligning plate, is moved in the direction opposite to the sheet conveying direction to align the sheet every time a sheet is stacked.

In Japanese Patent Application Laid-Open No. H11-228033, an apparatus is described in which there is provided a sheet tray, a side guide regulating the position of the side edge portion of a sheet, and an end guide regulating the position of the end edge portion of the sheet. In this apparatus, every time the sheet is conveyed onto a sheet tray, both the side guide and the end guide are moved from the standby position to a position regulating the sheet. Furthermore, it is constructed such that in the state in which the side guide is located in a position of regulating the sheet, the end guide is moved to the position of regulating the sheet. In addition, the side guide and the end guide are constructed so as to start to move simultaneously from the position of regulating the sheet to the standby position.

In Japanese Patent Application Laid-Open No. H11-228033, only after the side guide and the end guide have returned to respective standby positions, can the next sheet be conveyed to the sheet tray. Therefore, in Japanese Patent Application Laid-Open No. H11-228033, it is difficult to discharge sheets at high speed, resulting in a low productivity.

SUMMARY OF THE INVENTION

Thus, in view of such current status, the present invention provides a sheet stacking apparatus in which sheets can be stably stacked at high speed as well as with high accuracy, and an image forming apparatus having the sheet stacking apparatus.

According to a first aspect of the present invention, there is provided a sheet stacking apparatus as specified in claims 1 to 4. According to a second aspect of the invention, there is provided an image forming apparatus as specified in claim 5. The present invention provides in one embodiment a sheet stacking apparatus including: a sheet stacking portion on which a sheet is stacked; a sheet conveying portion which conveys the sheet onto the sheet stacking portion; first aligning means movable along a sheet conveying direction of the sheet conveying portion to align the position in the sheet conveying direction of a sheet stacked on the sheet stacking portion; and second aligning means movable in a width direction crossing the sheet conveying direction to align the position in the width direction of the sheet stacked on the sheet stacking portion, and control means, wherein the second aligning means aligns the sheet stacked on the sheet stacking portion, and the first aligning member aligns the sheet which has been aligned by the second aligning means, and the sheet conveying portion is controlled by the control means to convey a next sheet onto the sheet stacking portion while the first aligning member is moving to align the previous sheet.

According to the present invention, an apparatus in which sheets can be stacked with high accuracy in alignment as well as at high speed can be provided.

Further features of the present invention will become apparent from the following description of exemplary embodiments with reference to the attached drawings.

DESCRIPTION OF THE EMBODIMENTS

Figure 1:
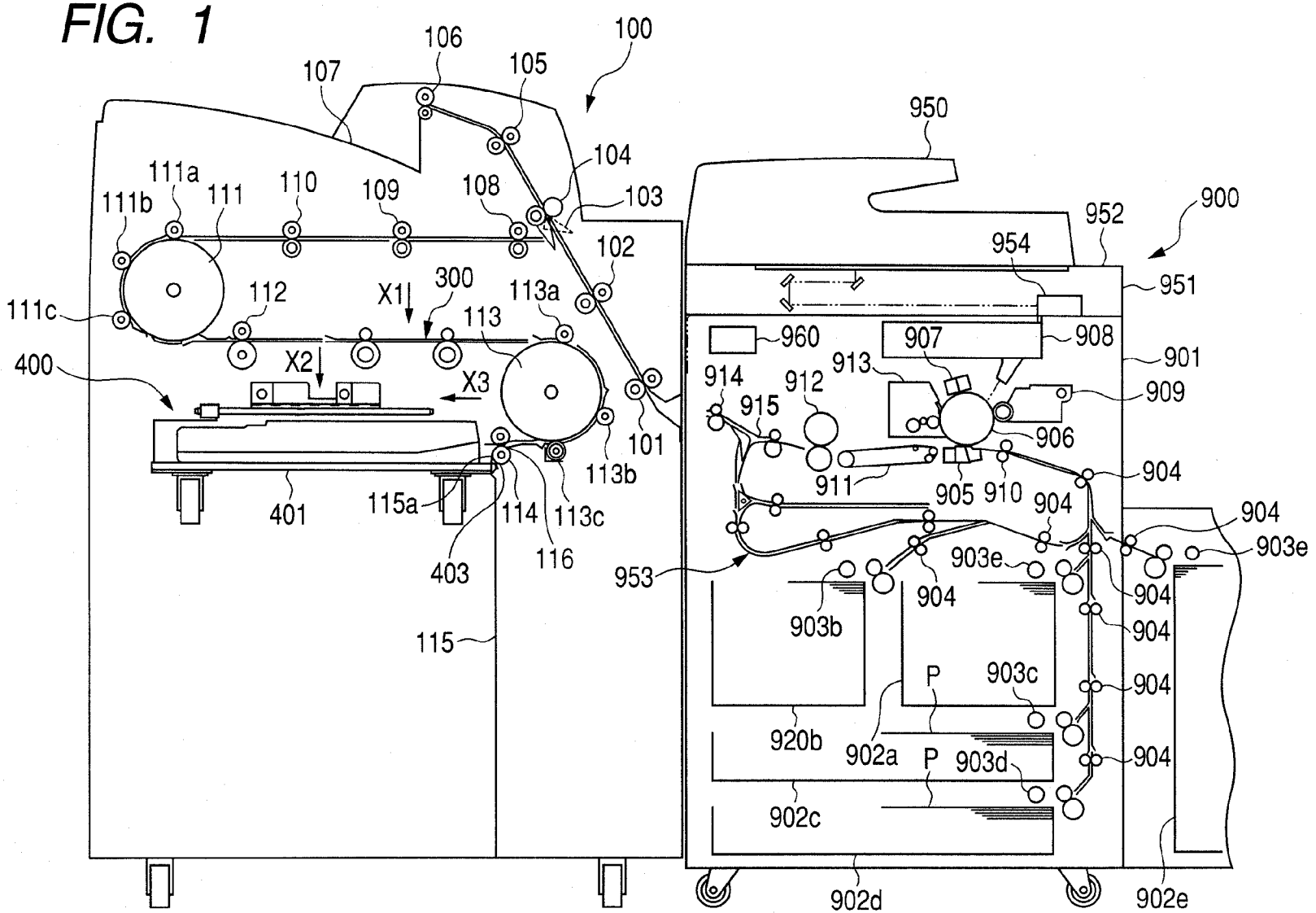
FIG. 1 is a diagram illustrating a configuration of an image forming apparatus including a sheet stacking apparatus according to an embodiment of the present invention.

An exemplary embodiment for carrying out the present invention will now be described in detail referring to the drawings.

FIG. 1 is a diagram illustrating a configuration of an image forming apparatus including a sheet stacking apparatus according to an embodiment of the present invention.

In FIG. 1, an image forming apparatus main body 901 of an image forming apparatus 900 includes an image reading apparatus 951 provided with a scanner unit 955 and an image sensor 954, an image forming portion 902 to form an image on a sheet, a two-side reversing device 953, and a platen glass 952. In addition, a document feeder 950 for feeding documents to the platen glass 952 is provided above the image forming apparatus main body 901.

The image forming portion 902 includes a cylindrical photosensitive drum 906, a charging device 907, a developing device 909, a cleaning device 913, and in addition, a fixing device 912 and a pair of discharging rollers 914 are disposed in the downstream side of the image forming portion 902. Also, the image forming apparatus main body 901 is connected with a stacker 100, which is a sheet stacking apparatus for stacking sheets that have been formed with images thereon and are discharged from the image forming apparatus main body 901. A controller 960 controls the image forming apparatus main body 901 and the stacker 100.

Next, an image forming operation of the image forming apparatus main body 901 configured as above will be described.

When an image forming signal is output from the controller 960, firstly a document is placed on the platen glass 952 by the document feeder 950 and the document image is read by the image reading device 951. Digital data obtained through reading is input to an exposure unit 908, by which light according to the digital data is irradiated onto the photosensitive drum 906.

On this occasion the surface of the photosensitive drum 906 is uniformly charged by the charging device 907. When light is irradiated as described above, an electrostatic latent image is formed on the surface of the photosensitive drum. Through development of the electrostatic latent image by the developing device 909, a toner image is formed on the surface of the photosensitive drum.

When a sheet feeding signal is output from the controller 960, firstly sheets P, which are set in cassettes 902*a*, 902*b*, 902*c*, 902*d* and 902*e*, are conveyed to the registration roller 910 through the feeding rollers 903*a*, 903*b*, 903*c*, 903*d* and 903*e*, and a pair of conveying rollers 904.

Then sheets P are conveyed to a transfer portion which includes a transfer-separation charging device 905 by the registration roller 910 with such timing that the leading edge of a sheet is aligned with the leading edge of the toner image on the photosensitive drum 906. Then, in the transfer portion, a transfer bias is applied to the sheet P by the transfer-separation charging device 905, and thus the toner image on the photosensitive drum 906 is transferred to the sheet.

Subsequently, the sheet P on which a toner image was transferred is conveyed to the fixing device 912 by a conveying belt 911, and thereafter the toner image is thermally-fixed while being nipped between a heating roller and a pressure roller of the fixing device 912. Meanwhile foreign substances such as residual toner not transferred to the sheet are removed by a blade of the cleaning device 913. Consequently the surface of the photosensitive drum 906 becomes clean to be ready for the subsequent image forming.

The fixed sheet is conveyed to the stacker 100 by the discharging roller 914 or conveyed to the two-side reversing device 953 by a flapper 915 to perform an image forming process again.

In the meanwhile, the stacker 100 is provided with a top tray 107 in an upper part thereof for stacking the sheets discharged from the image forming apparatus main body 901. The stacker 100 also performs skew feed correction and lateral registration correction (positional correction in the direction of crossing the conveying direction) of the sheets fed out of the image forming apparatus main body 901. In addition the stacker 100 includes a grouping portion 300 where sorting of shift mode, which is described later, is carried out.

Moreover the stacker 100 includes a stacking portion 400 provided with a stack tray 401 for sheet stacking, and a top tray switching flapper 103, which directs sheets conveyed in the stacker 100 toward the top tray 107 or toward the stacking portion 400. The configurations of the grouping portion 300 and the stacking portion 400 will be described later.

Figure 2:
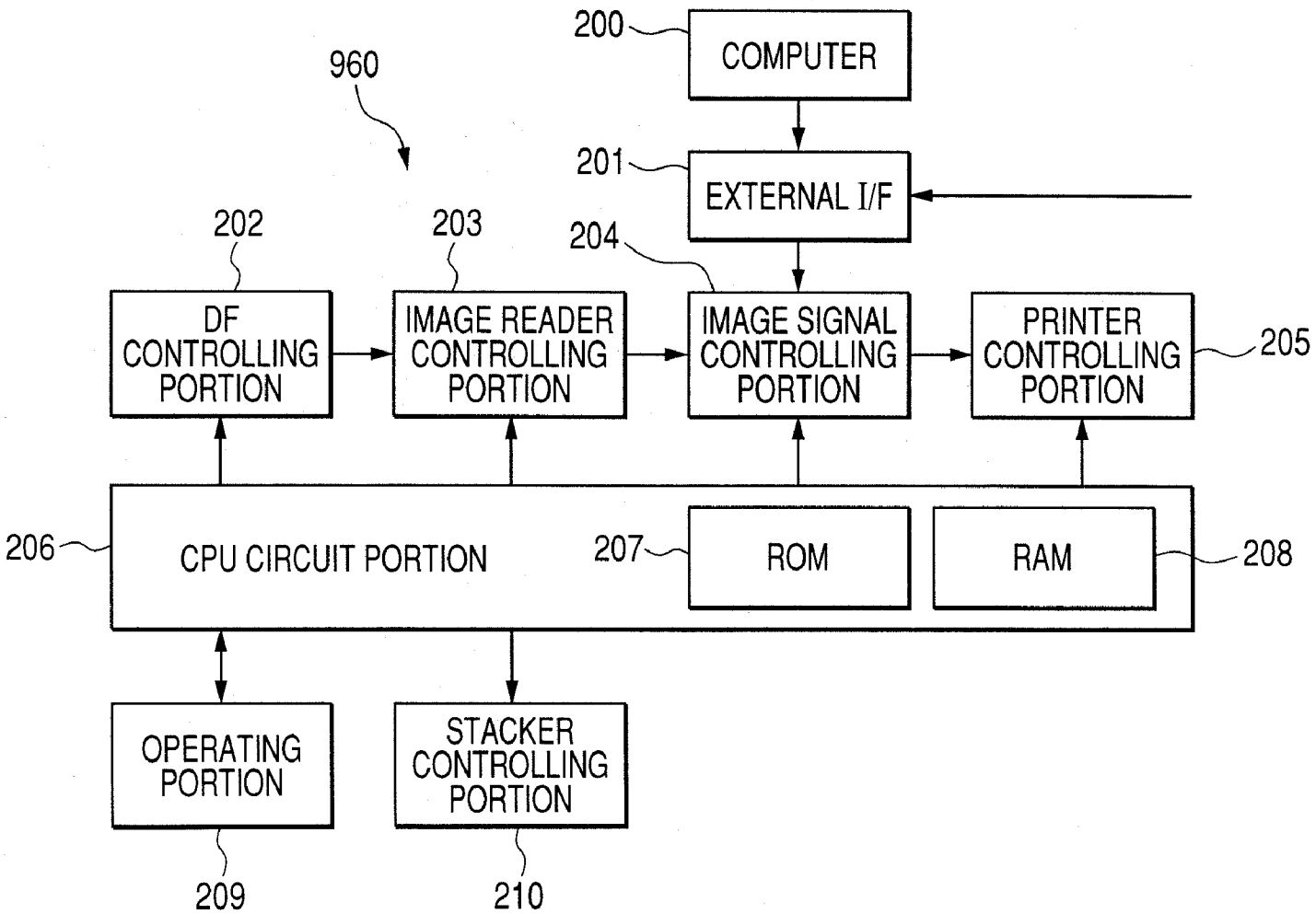
FIG. 2 is a control block diagram of a controller provided in the above image forming apparatus.

FIG. 2 is a block diagram illustrating a configuration of the controller 960. The controller 960 has a CPU circuit portion 206, which includes a CPU (not shown), a ROM 207 and a RAM 208 therein. The controller 960 controls comprehensively, through the control program stored in the ROM 207, a DF (document feeding) controlling portion 202, an operation portion 209, an image reader controlling portion 203, an image signal controlling portion 204, a printer controlling portion 205, and a stacker controlling portion 210. The RAM 208 holds the control data temporarily and is utilized as a working area for computing operations required for control.

The DF (document feeding) controlling portion 202 performs drive control of the document feeding device 950 based on an instruction from the CPU circuit portion 206. The image reader controlling portion 203 performs drive control of the scanner unit 955 and image sensor 954 disposed in the image reading device 951 and transmits analogue image signals output from the image sensor 954 to the image signals controlling portion 204.

The image signal controlling portion 204 converts the analogue image signals from the image sensor 954 to the digital signals and thereafter performs various processes. The digital signals are converted to video signals and output to the printer controlling portion 205.

The image signal controlling portion 204 also performs various processes for the digital image signals input from the computer 200 or from outside via an external I/F 201 and converts the digital image signals to video signals to output the video signals to the printer controlling portion 205. Note that the processes through the image signals controlling portion 204 are controlled by the CPU circuit portion 206.

The printer controlling portion 205 drives the exposure unit 908 via an exposure controlling portion (not shown) based on the input video signals. The operation portion 209 includes a plurality of keys for setting various functions regarding image formation and a displaying portion for displaying the information indicating the setting state. The operation portion 209 also outputs key signals corresponding to each key operation to the CPU circuit portion 206 and displays the corresponding information on the display portion based on the signals from the CPU circuit portion 206.

The stacker controlling portion 210 is mounted in the stacker 100 and performs driving control of the whole stacker through information communication with the CPU circuit portion 206.

Figure 3:
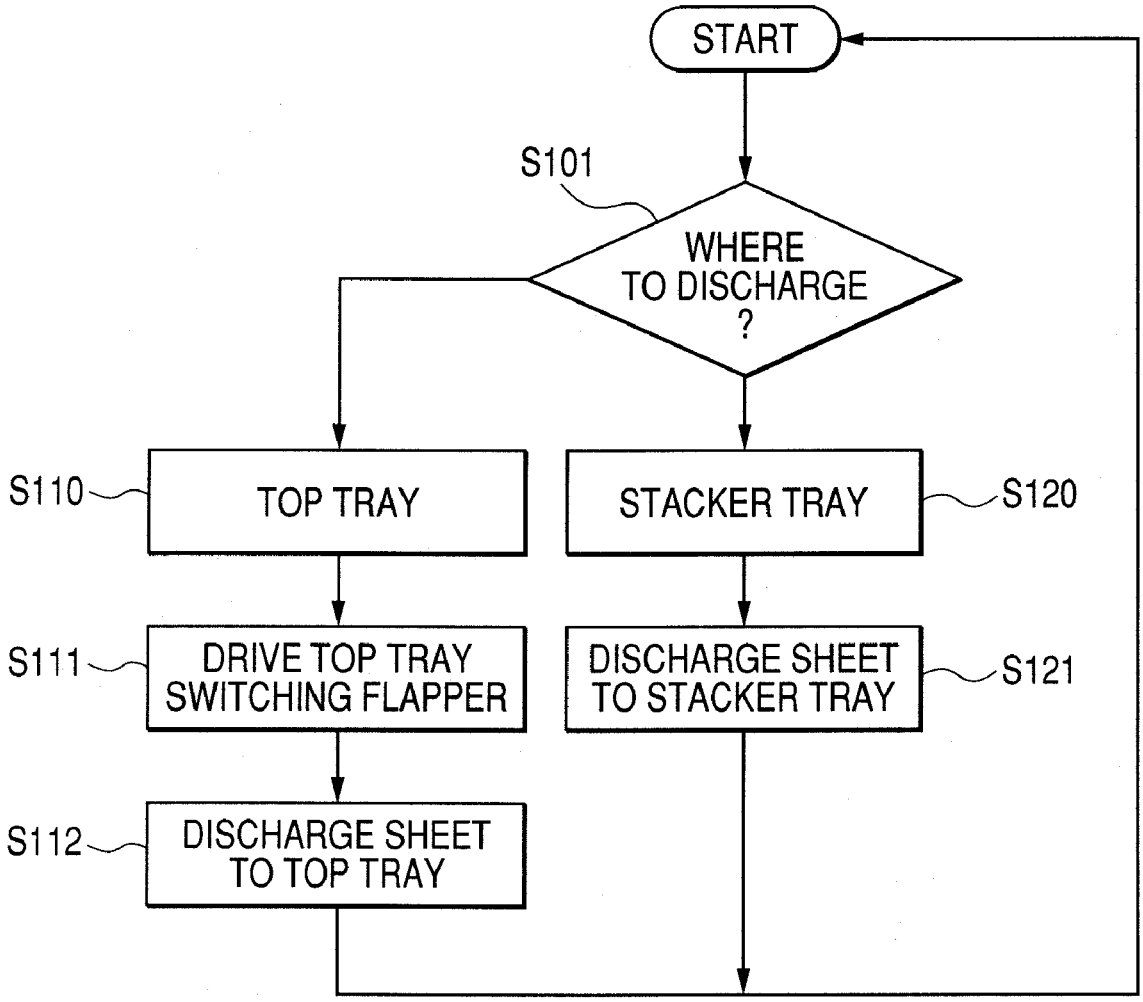
FIG. 3 is a flowchart illustrating basic control of a stacker connected to an image forming apparatus main body in the above image forming apparatus.

Next, a basic control in the stacker controlling portion 210 of the stacker 100 will be described referring to FIG. 1 and a flowchart of FIG. 3.

The sheet P discharged from the image forming apparatus main body 901 is conveyed into the internal portion by a pair of inlet rollers 101 of the stacker 100 and conveyed to the top tray switching flapper 103 by a pair of conveying rollers 102.

Before the sheet is conveyed, sheet information, such as sheet size, sheet type, where to discharge the sheet and the like have been transmitted to the stacker controlling portion 210 from (the CPU circuit portion 206 of) the controller 960 in the image forming apparatus main body 901.

Here, the stacker controlling portion 210 determines where to discharge the sheet which has been conveyed from the controller 960 (S101) If where to discharge the sheet is to the top tray 107 (S110), the top tray switching flapper 103 is driven (S111) via a solenoid (not shown) to move to the position as illustrated in FIG. 1. Consequently, the sheet P is guided to the pair of conveying rollers 104 and 105, after which the sheet is discharged to the top tray 107 by the top tray discharging roller 106 (S112), then stacked.

If where to discharge the sheet is to the stack tray 401 of the stacking portion 400 (S120), the top tray switching flapper 103 is moved to the dotted line position by the solenoid (not shown). Consequently, the sheet conveyed by the pair of conveying rollers 102 passes between the pairs of conveying rollers 108, 109, and 110, and through nip portion between a large roller 111 and the rollers 111*a*, 111*b*, and 111*c*. Further the sheet passes through the conveying roller 112, the grouping portion 300 and the nip portion between the large roller 113 and the rollers 113*a*, 113*b*, 113*c*, thereafter the sheet is discharged to the stacking tray 401 (S121) by the discharging rollers 114, and then stacked.

The grouping portion 300, which corrects skew feed and lateral registration of the sheets conveyed from the image forming apparatus main body 901 as well as providing a space for sorting operation of the shift mode, which is described later, is arranged between the conveying rollers 112 and the large roller 113 as illustrated in FIG. 1.

Figure 4:
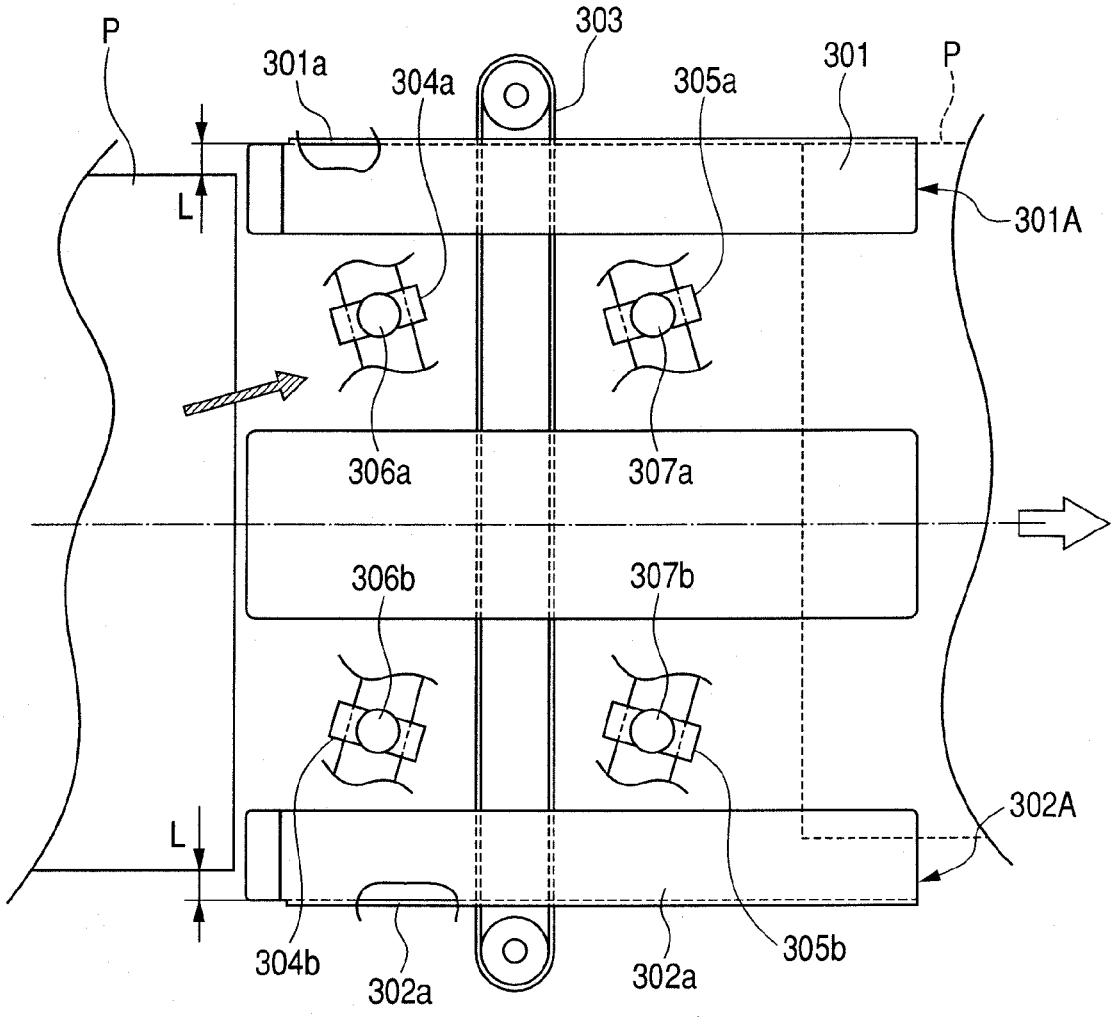
FIG. 4 is a diagram illustrating a configuration of a grouping portion provided in the above stacker.

Here, as indicated by a white arrow in FIG. 4 that is a view looking in the direction indicated by the arrow X1 of FIG. 1, the grouping portion 300 is fixed to a timing belt 303 and is provided with first and second guides 301, 302, which are movable symmetrically with respect to the center line of the sheet moving in the conveying direction.

On the opposing side surfaces of the first and second guides 301 and 302, guide portions 301A and 302A are formed, which include a bottom surface supporting the lower surface of the sheet P and a ceiling surface restricting the upward movement of the sheet P, and the abutting surfaces 301*a* and 302*a* against which the side edges of the sheet P abut.

Then, when the sheet P is conveyed, the first and second guides 301 and 302 are in standby positions having the abutting surfaces 301*a* and 302*a* opened wider by a distance L from each side edge of the sheet depending on the sheet size in a condition that the center line of the abutting surfaces 301*a*, 302*a* are aligned with the center line of the sheet in the conveying direction.

The grouping portion 300 includes the first and second oblique-feed rollers 304*a* and 305*a* that are inclined so that the sheet P is fed obliquely toward the first guide side, and includes the third and fourth oblique-feed rollers 304*b* and 305*b* that are inclined so that the sheet P is fed obliquely toward the second guide side. Rollers 306*a* and 307*a* are the first and second rollers that are selectively brought into contact with the first and second oblique-feed rollers 304*a* and 305*a* so as to nip the sheet P. Rollers 306*b* and 307*b* are the third and fourth rollers that are selectively brought into contact with the third and fourth oblique-feed rollers 304*b* and 305*b* so as to nip the sheet P.

The first to the fourth oblique-feed rollers 304*a*, 305*a*, 304*b* and 305*b* are formed by rubber or sponge with a low coefficient of friction so that slip on the sheet P gives no damage thereon under a predetermined load. The first to the fourth rollers 306*a*, 307*a*, 306*b* and 307*b* are arranged to be brought into contact with the first to the fourth oblique-feed rollers 304*a*, 305*a*, 304*b* and 305*b* selectively by solenoid (not shown).

In the grouping portion 300 configured as described above, the sheet P conveyed by the conveying roller 112 is now conveyed by the oblique-feed rollers 304 and 305, having the both edges of the sheet pass within the first and second guide portions 301 and 302.

Here, the grouping portion 300 conveys the sheet P with a shift toward the first and second guide sides, thereby correcting skew feed of the sheet P and controlling the position of the sheet P in the width direction.

For example, in order to shift the sheet P toward the first guide side, the first and second rollers 306*a* and 307*a* are brought into contact with the first and second oblique-feed rollers 304*a* and 305*a*, and the third and fourth rollers 306*b* and 307*b* are kept separated from the third and fourth oblique-feed rollers 304*b* and 305*b*.

Accordingly, a conveying force with the direction of the hatched arrow is applied to the sheet P by the first and second oblique-feed rollers 304*a* and 305*a*. The guide portion 301A of the first guide 301 restricts the movement in upper and lower direction at the edge of the first guide side, and the sheet moves while abutting on the abutting surface 301*a*. As a result, skew feed of the sheet P is corrected and also the position in width direction can be set by the abutting surface 301*a*, as shown by the dotted line.

When the sheet P is to be shifted toward the second guide side, the third and fourth rollers 306*b* and 307*b* are brought into contact with the third and fourth oblique-feed rollers 304*b* and 305*b*, and the first and second rollers 306*a* and 307*a* are kept separated from the first and second oblique-feed rollers 304*a* and 305*a*.

Accordingly, a feeding force is applied to the sheet P by the third and fourth oblique-feed rollers 304*b* and 305*b*. The guide portion 302A of the second guide 302 restricts the movement of the sheet in upper and lower directions at the edge of the second guide side, and the sheet P moves while abutting on the abutting surface 302*a*. As a result, skew feed of the sheet P is corrected and also the position in width direction can be set by the abutting surface 302*a*.

According to the arrangement described so far, each sheet bundle can have an alteration of shift direction by controlling the contact and separation of the first to the fourth rollers 306*a*, 307*a*, 306*b* and 307*b*. Having such alteration of the shift direction, the shift amount between the sheet bundles becomes 2 L.

Next, the configuration of the stacking portion 400 for containing a large volume of sheets will be described referring to FIG. 5, which is a view looking in the direction indicated by the arrow X2 of FIG. 1, FIG. 6, which is a view looking in the direction indicated by the arrow X3 of FIG. 1 and FIG. 7 which is a cross-sectional view along the line VII-VII of FIG. 5.

Figure 5:
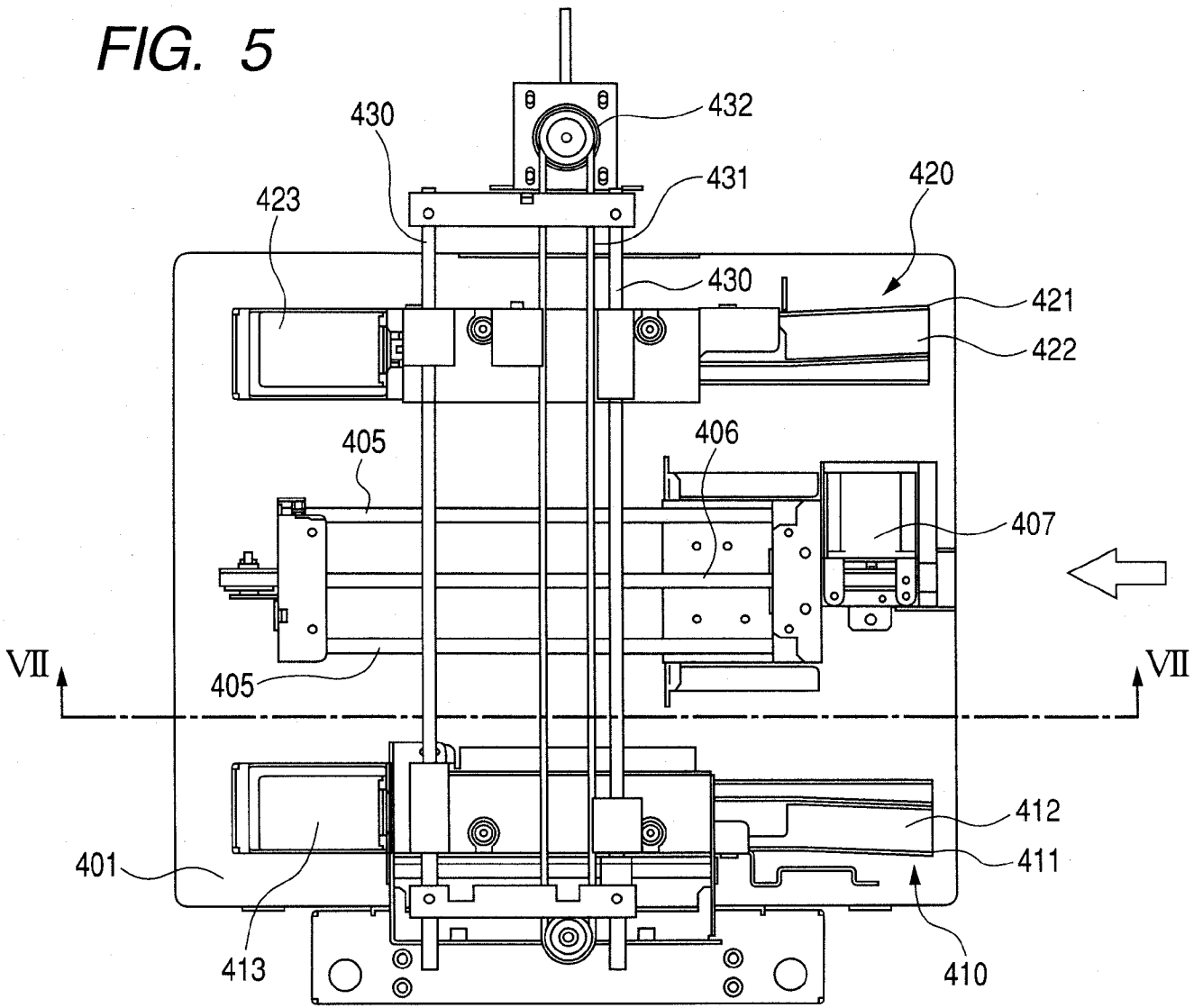
FIG. 5 is a diagram illustrating a configuration of a stacking portion provided in the above stacker.
Figure 6:
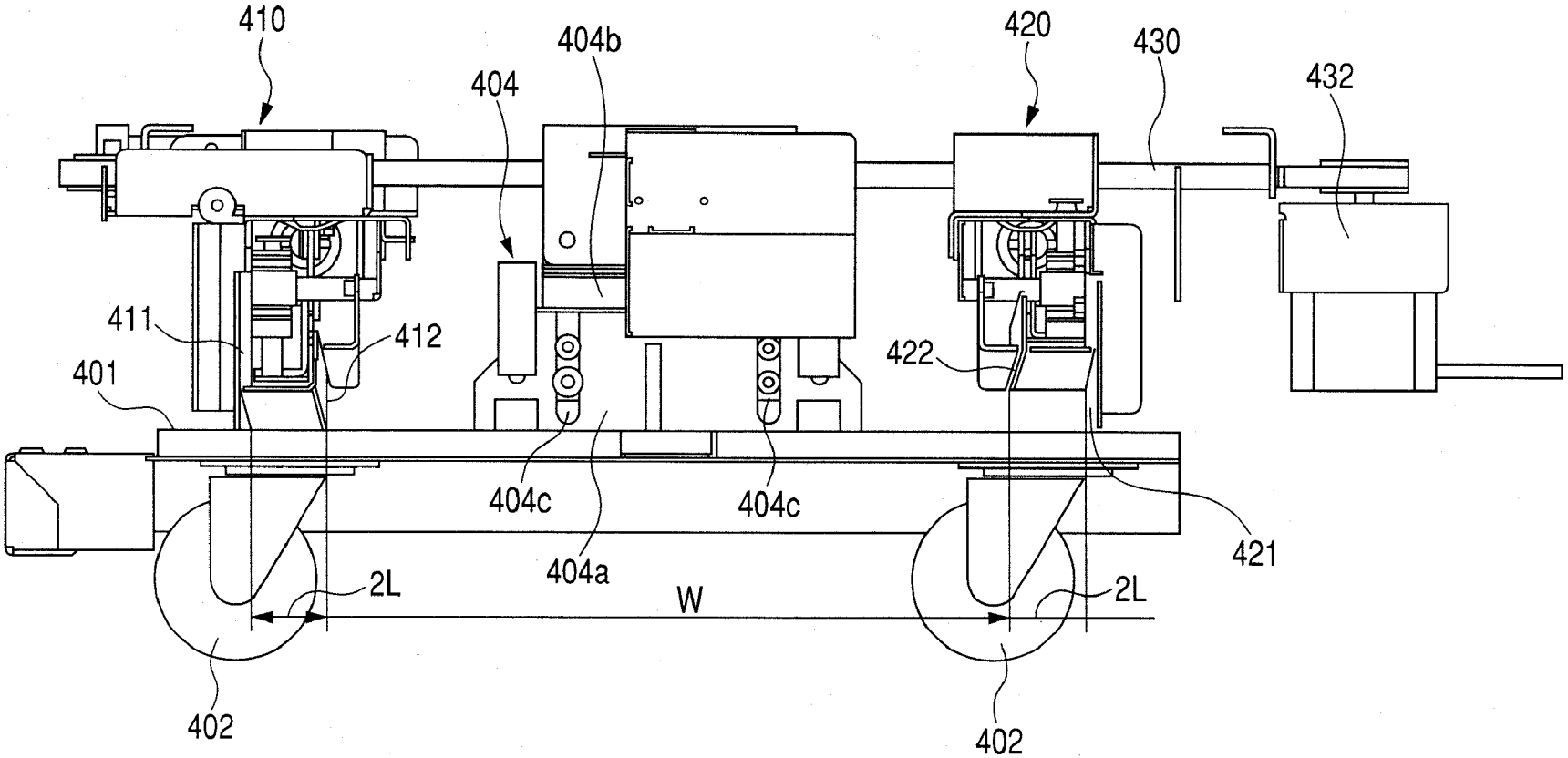
FIG. 6 is a diagram illustrating a configuration of the above stacking portion.
Figure 7:
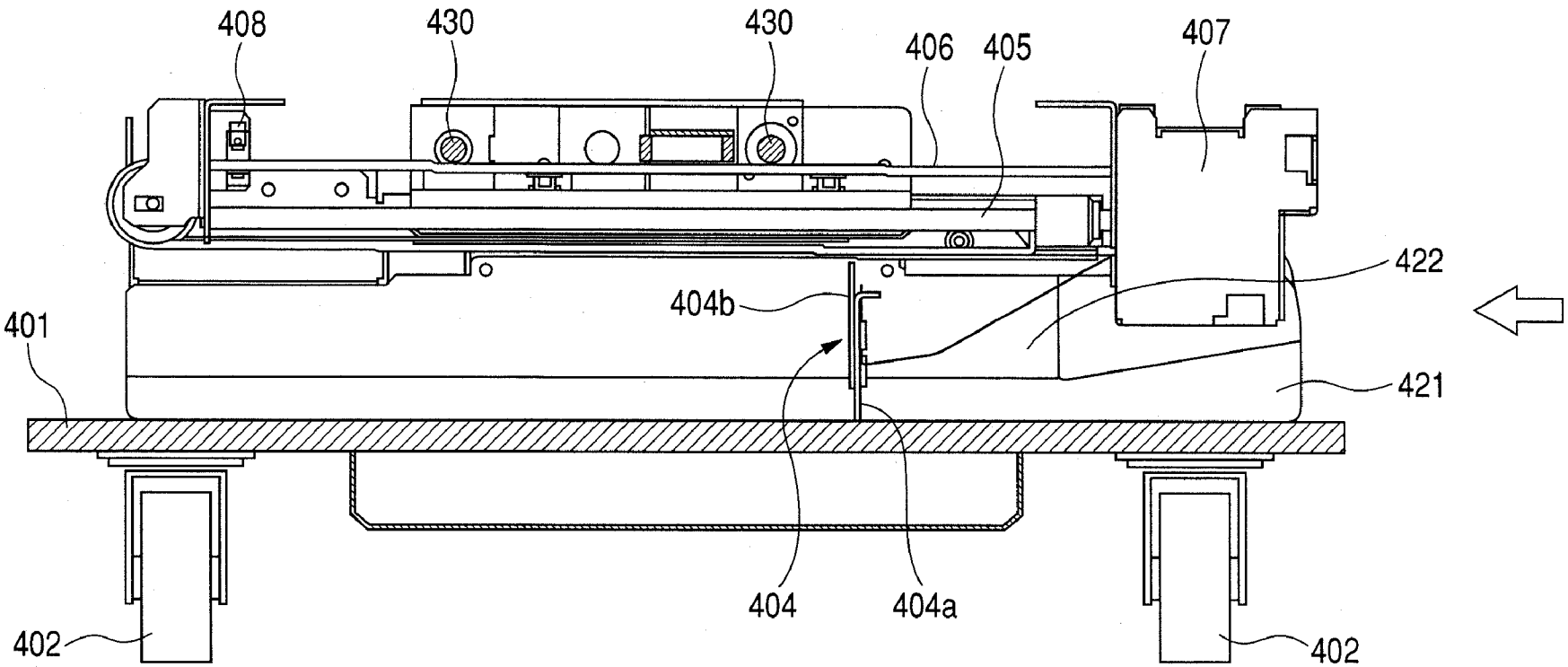
FIG. 7 is a sectional view along the line VII-VII of FIG. 5.

The stacking portion 400, as illustrated in FIGS. 5 to 7, includes a stack tray 401, which is a sheet stacking portion for stacking sheets horizontally, a leading edge stopper 404 as a first aligning member. The stacking portion 400 further includes first and second side stoppers 410, 420.

The stack tray 401 is arranged to be movable in up and down direction (capable of lifting and lowering) by a lift motor, which is a lifting and lowering unit (not shown). The stack tray 401 is disposed below the discharging roller 114, which discharges the sheet P to the stack tray 401 and the sheet surface detection sensor 403 detects the sheet position of the stack tray 401. The height position of the stack tray 401 is controlled by the stacker controlling portion 210 so that the top position of the sheets in the stack tray 401 is always constant based on the output of the sheet position detecting sensor 403.

Figure 8:
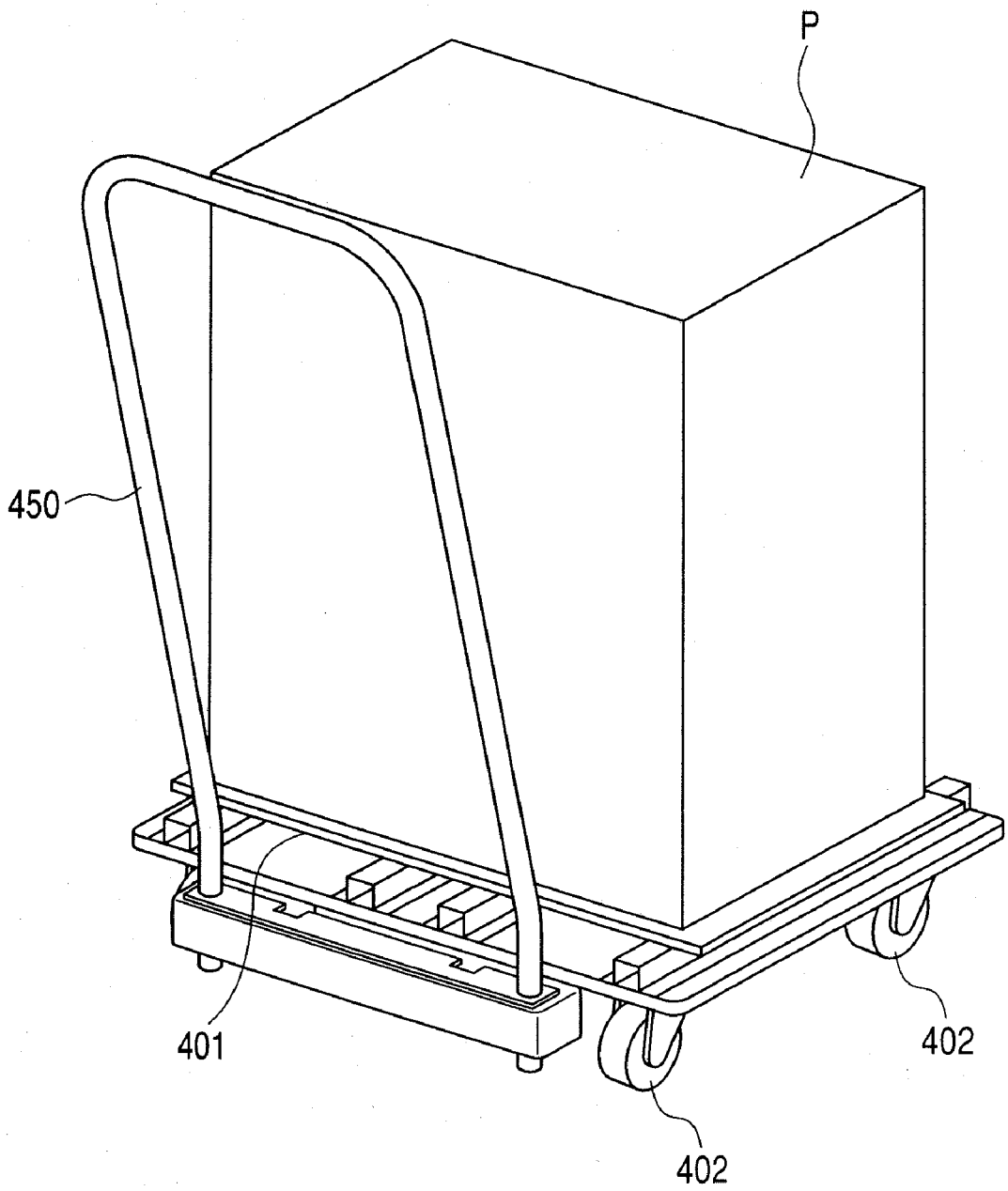
FIG. 8 is a diagram illustrating a configuration of a stack tray provided in the above stacker.

Four casters 402 are mounted on the bottom face of the stack tray 401 so that the whole stack tray 401 can be pulled out from the stacker 100 to be conveyed when a job is completed. FIG. 8 illustrates a state of sheets P of large size stacked in a shiftless manner. A handle 450 is attached to the stack tray 401 to improve conveyance.

The leading edge stopper 404 is to abut on and restrain the leading edge of the sheet (a downstream edge in the sheet discharging direction) discharged to the stack tray 401 in the direction indicated by the arrow in FIGS. 5 and 7. The leading edge stopper 404 is supported by the two slide rails 405 above the stack tray 401 and disposed between the two slide rails 405. Also the leading edge stopper 404 is fixed to the belt 406, which can move in the sheet conveyance (discharging) direction. Therefore, if the motor 407 is rotated in forward and reverse directions, the leading edge stopper 404 moves in the sheet conveying direction and the reverse direction.

The leading edge stopper 404 includes a leading edge plate 404*a* having a substantially vertical surface to restrain the sheet edge discharged to the stack tray 401 and a fixing member 404*b*, which has an L-like shape connecting the belt 406 and the leading edge plate 404*a*.

The leading edge plate 404*a*, as illustrated in FIG. 6, is supported by a fixing member 404*b* via four bushes 404*c* so as to be slidable vertically within a predetermined area. Owing to such arrangement, the leading edge plate 404*a* abuts on the stack tray surface by the own weight when no sheet is stacked on the stack tray 401. Also the edge plate descends as the stack tray descends.

A sensor 408 detects the position of the leading edge stopper 404. The stacker controlling portion 210 drives the motor 407 based on the size information of the sheet to be stacked to move the leading edge stopper 404 appropriately.

Figure 11:
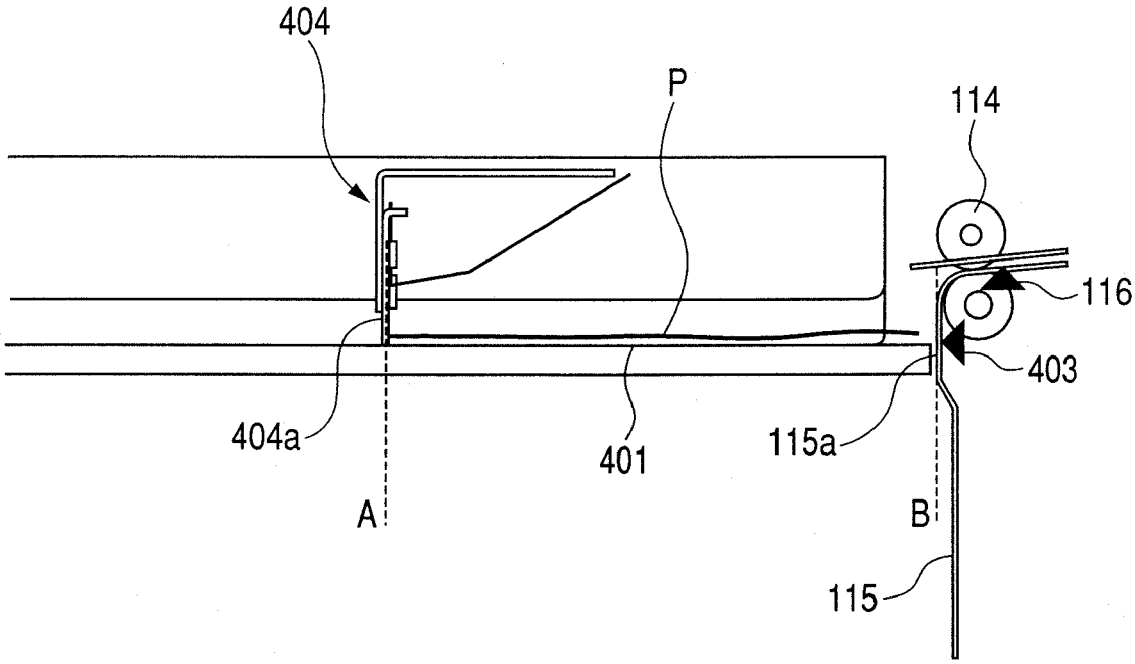
FIG. 11 is a diagram illustrating a state in a case where a shiftless mode of the above stacking portion is selected.

As illustrated in FIG. 1 or FIG. 11, which will be described later, a trailing edge guide 115 is mounted facing the leading edge stopper 404 as the first aligning member immediately below the discharging roller 114 as a conveying portion. Consequently, the position of the sheets P contained in the stack tray 401 in the conveying direction is restricted by a span between the leading edge stopper 404 and an abutting surface 115*a* of the trailing edge guide 115 illustrated in FIG. 11 to be described later.

The first and second side stoppers 410 and 420 are provided upstream from the leading edge stopper 404 in the sheet discharging direction and make up second aligning members to align the positions of both sides of the width direction of the sheet discharged to the stack tray 401.

The first and second side stoppers 410 and 420 are supported by two slide rails 430 above the stack tray 401 and are fitted to a belt 431 driven by the motor 432 so as to be movable in the width direction getting nearer to or further away from each other.

The stacker controlling portion 210 drives the motor 432 based on the sheet size information to move the first and second side stoppers 410 and 420 appropriately corresponding to the signals from the sensor (not shown).

Here, the first and second side stoppers 410, 420 are provided with external plates 411, 421, and internal plates 412, 422 having vertical surfaces to align the sheet side edges. The respective gaps between the external plates 411, 421 and the internal plates 412, 422, illustrated in FIG. 6, are equivalent to the shift amount 2 L in the grouping portion 300.

The external plates 411, 421 are supported, similarly to the leading edge plate 404*a* of the leading edge stopper 404 as described above, by the first and second side stoppers 410, 420 so as to be slidable vertically within a predetermined area via sliding members (not shown). Owing to this arrangement, the external plates 411, 421 abut on the stack tray surface by gravity when no sheet is stacked on the stack tray 401. Also the external plates 411, 421 descend as the stack tray descends.

The internal plate 412, 422, which are aligning members, are arranged to lift and lower via solenoids 413, 423 and links (not shown). The internal plates 412, 422 are arranged to be supported by a support unit including the solenoids 413, 423 and the links so as to be capable of descending by a certain distance accompanied by descending of the stack tray 401 in a state that the internal plates 412, 422 are laid on the sheet bundles stacked in the sheet tray 401. Note that in the exemplary embodiment the descending distance of the internal plates 412, 422 is shorter than that of the other aligning members of external plates 411, 421 and the leading edge plate 404*a*, which is an abutting member of the leading edge stopper 404.

Due to this arrangement, as described later, when the number of the stacked sheets becomes 40, for example, and then the stack tray 401 descends corresponding to the number of sheets stacked, the internal plates 412, 422 become released from the sheet in the stack tray.

It should be noted that in FIG. 6 the internal plate 412 in the side of the first side stopper (hereinafter referred to as the first internal plate) is positioned lower due to the off-state of the solenoid 413, in which state the internal plate 412 abuts on the stack tray surface if there is no sheet in the stack tray 401, and abuts on the top sheet if there are sheets. On the other hand, the internal plate 422 in the side of the second side stopper (hereinafter referred to as the second internal plate) is positioned higher due to the on-state of the solenoid 423.

Here, in a case where the sheet P is to be shifted with respect to the first guide 301 in the aforementioned grouping portion 300, the first internal plate 412 is placed in the lower position, which is an aligning position abutting on the side edge of the sheet P to align the width direction position. Meanwhile the second internal plate 422 is in a higher position, which is an upper retreat position. Thereby the sheet that is shifted with respect to the first guide 301 in the grouping portion 300 is stored between the first internal plate 412 and the external plate (hereinafter referring to the second external plate) 421 of the second side stopper 420.

In the case where the sheet P is stored, which was shifted with respect to the second guide 302 in the grouping portion 300, the first internal plate 412 is placed at the higher position and the second internal plate 422 is placed at the lower position. Thereby the sheets are stored between the external plate (hereinafter referring to as the first external plate) 411 of the first side stopper 410 and the second internal plate 422.

Next, the sheet stacking operation to the stacking portion 400 in the stacker 100 will be described. Note that the stacker 100 includes two modes in the present embodiment, which are a shiftless mode where all the sheets in the stack tray are stacked at the same position and a shift mode where the sheets discharged to the stack tray are stacked while being shifted in the width direction for every bundle of the sheets.

Firstly, the sheets stacking operation in the shiftless mode will be described.

When the shiftless mode is selected, the shift direction at the grouping portion 300 maintains the same and an operator can select a shift between to the first guide side and to the second guide side. Here the shift to the first guide side will be described.

When the shift to the first guide side is selected by the operating portion 209 illustrated in FIG. 2, the stacker controlling portion 210 outputs a control signal to the grouping portion 300 and the stacking portion 400 via the CPU circuit portion 206 before the sheet is conveyed to the stacker 100.

Based on this control signal, the grouping portion 300 makes the first and second guides 301, 302 stand by at a position expanded by a dimension L with respect to the sheet size (width) respectively. In addition, the first and second rollers 306*a*, 307*a*, which are illustrated in FIG. 4, are made to be in contact with the first and second oblique-feed rollers 304*a*, 305*a* and the third and fourth rollers 306*b*, 307*b* are kept to stand by at positions away from the third and fourth oblique-feed rollers 304*b*, 305*b*.

In the stacking portion 400, the first and second side stoppers 410, 420 are kept to stand by, as illustrated in FIG. 6, such that the first and second external plates 411, 421 are positioned in standby positions expanded (by 2 mm) slightly wider than 2 L with respect to the sheet size (in the sheet width direction) W, respectively. Further, the first internal plate 412 is placed to stand by at the lower position and the second internal plate 422 is placed to stand by at the higher position.

Further the leading edge stopper 404 is kept to stand by at a standby position in which the distance between the leading edge plate 404*a* and the abutting surface 115*a* of the trailing edge guide 115 is slightly wider (by 2 mm) than the sheet size (sheet length in sheet conveying direction). At that time, the stack tray 401 stands still in a state that the sheet face (or the stack tray face if there is no sheet stacked) is detected by the sheet face detecting sensor 403.

Next, after the first and second guides 301, 302 and the first and second side stoppers 410, 420 are moved to the standby position (initial position), the sheets are conveyed to the stacker 100. The sheets conveyed to the stacker 100 like this are conveyed to the grouping portion 300 by the conveying roller 112 after passing through the pairs of conveying rollers 108 to 110 by switching of the top tray switching flapper 103.

Figure 9:
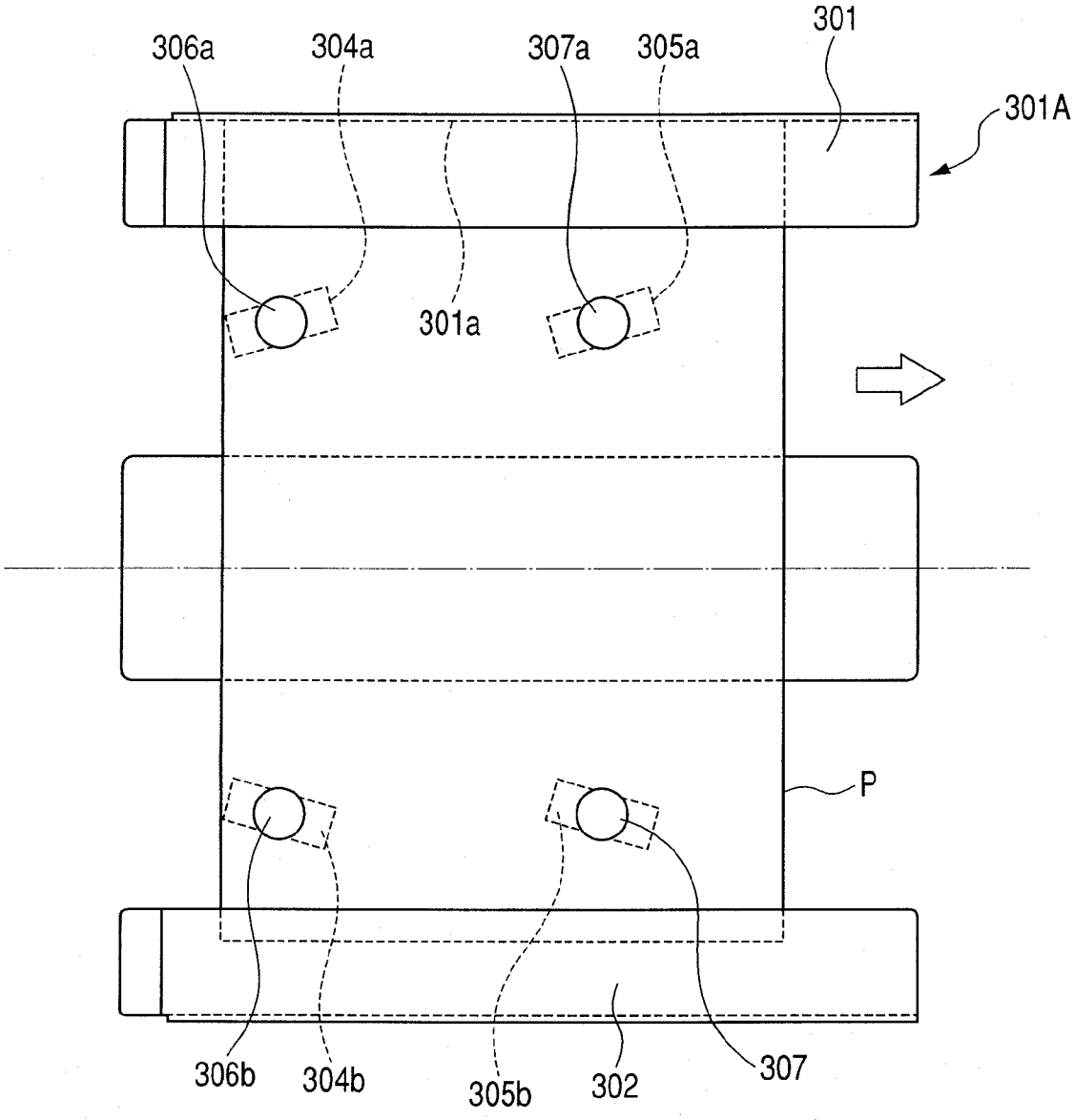
FIG. 9 is a diagram illustrating a state in a case where a shiftless mode of the above grouping portion is selected.

Then, in the grouping portion 300, as illustrated in FIG. 9, the sheet P is nipped between the first and second oblique-feed rollers 304*a*, 305*a* and the first and second rollers 306*a*, 307*a*, and conveyed in a skew feed manner to abut on the abutting surface 301*a* of the guide portion 301A on the first guide side. Thereby the sheet P is conveyed with reference to the abutting surface 301*a*, being corrected in the skew feed and the position of the width direction.

Figure 10A:
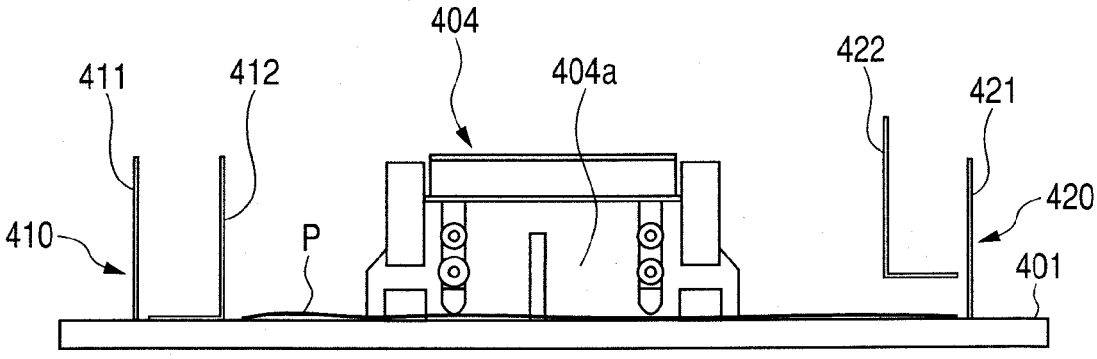
FIGS. 10A and 10B are diagrams illustrating states in a case where a shiftless mode of the above stacking portion is selected.

Thereafter, as illustrated in FIG. 10A, the sheet P is discharged to the stack tray 401 by the discharging roller 114, entering between the second external plate 421 and the first internal plate 412. On this occasion, as described already, the leading edge plate 404*a* of the leading edge stopper 404, the second external plate 421 and the first internal plate 412 are abutted against the stack tray surface.

Therefore, the leading edge of the discharged sheet P is stopped by the leading edge plate 404*a* of the leading edge stopper 404 as illustrated in FIG. 11. Also, the both side edges of the sheet P are confined by the second external plate 421 and the first internal plate 412, and the leading edge and trailing edge of the sheet P in the sheet discharging direction are confined by the leading edge plate 404*a* of the leading edge stopper 404 and the abutting surface 115*a* of the trailing edge guide 115.

Thereafter, the stacker controlling portion 210 drives the motor 432 to move the first and second side stoppers 410, 420 based on a detection signal of the sheet discharging sensor 116, which is disposed in the vicinity of the discharging roller 114 as illustrated in FIG. 11, for detection of the sheet P.

Figure 10B:
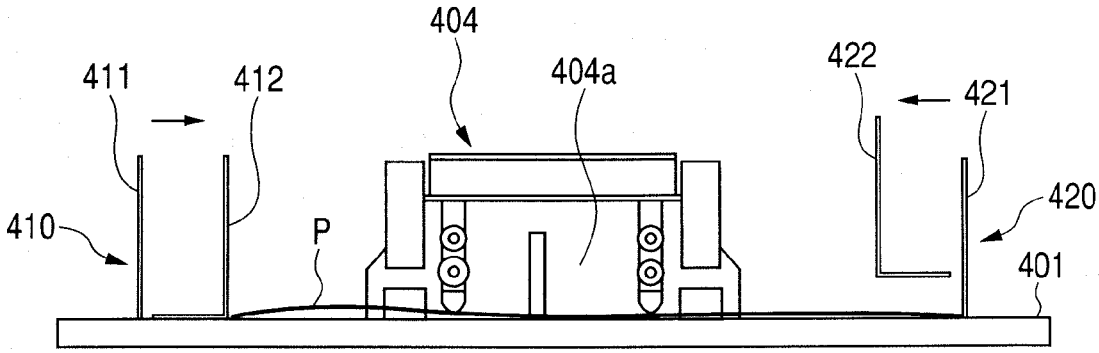

Owing to this, the first and second side stoppers 410, 420, which are disposed upstream of the leading edge stopper 404 in the sheet conveying direction, move to an aligning position (in the direction getting closer to the sheet P) by 2 mm respectively from the standby position, in directions indicated by the arrows in FIG. 10B. The distance between the second external plate 421 and the first internal plate 412 at the aligning position becomes equal to the sheet size (width). When the second external plate 421 and the first internal plate 412 move to the aligning position, the plates 421, 412 are brought into contact with the side edges of the sheet P, and thereby an aligning operation of the discharged sheet P in the width direction is performed.

After the width direction aligning operation described above has been performed, the first and second side stoppers 410, 420 move to standby positions expanded by 2 mm again to be ready for the subsequent discharged sheet.

Figure 12:
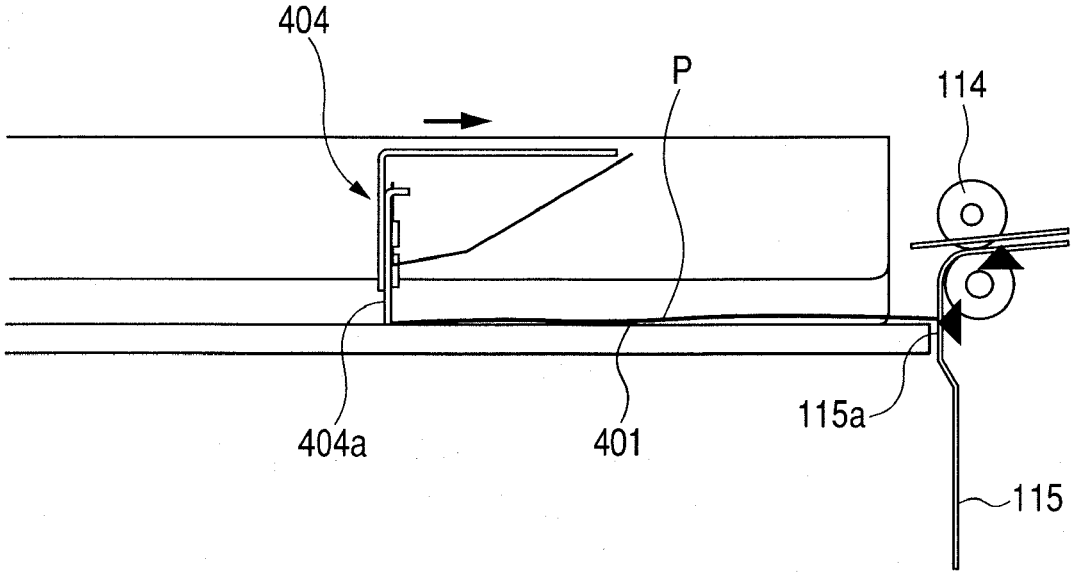
FIG. 12 is a diagram illustrating an aligning operation in a sheet conveying direction by a leading edge stopper of the above stacking portion.

Subsequently, as illustrated by an arrow in FIG. 12, the stacker controlling portion 210 controls the drive of the motor 407 so that the leading edge stopper 404 disposed downstream in the sheet conveying (discharging) direction moves to the aligning position inward (direction getting closer to the sheet P) by 2 mm. The distance between the leading edge plate 404*a* of the leading edge stopper 404 and the abutting surface 115*a* of the trailing edge guide 115 when the leading edge stopper 404 is positioned at the aligning position becomes equal to the length of the sheet P in the sheet conveying direction. Since, when the leading edge stopper 404 moves to the aligning position, the leading edge stopper 404 contacts with the leading edge of the sheet P, an aligning operation of discharged sheets P in the sheet conveying direction is performed.

The stacker controlling portion 210 controls the motor 407 so that the leading edge stopper 404 after performing the sheet aligning operation of the sheets P in the sheet conveying direction in this way, moves again to the standby position, which is a position 2 mm longer than the sheet length. The leading edge stopper 404 moves to the standby position to be ready for subsequent discharged sheet.

Thus, the above mentioned operation is repeated every time a sheet is discharged until the last sheet, and thereby a required number of sheets P is stacked in the stack tray 401. Until the required number of sheets P is stacked, the stacker controlling portion 210 constantly controls the height position of the top sheet surface in the stack tray 401 so as to be at the detecting position of the sheet surface detection sensor 403.

Figure 13:
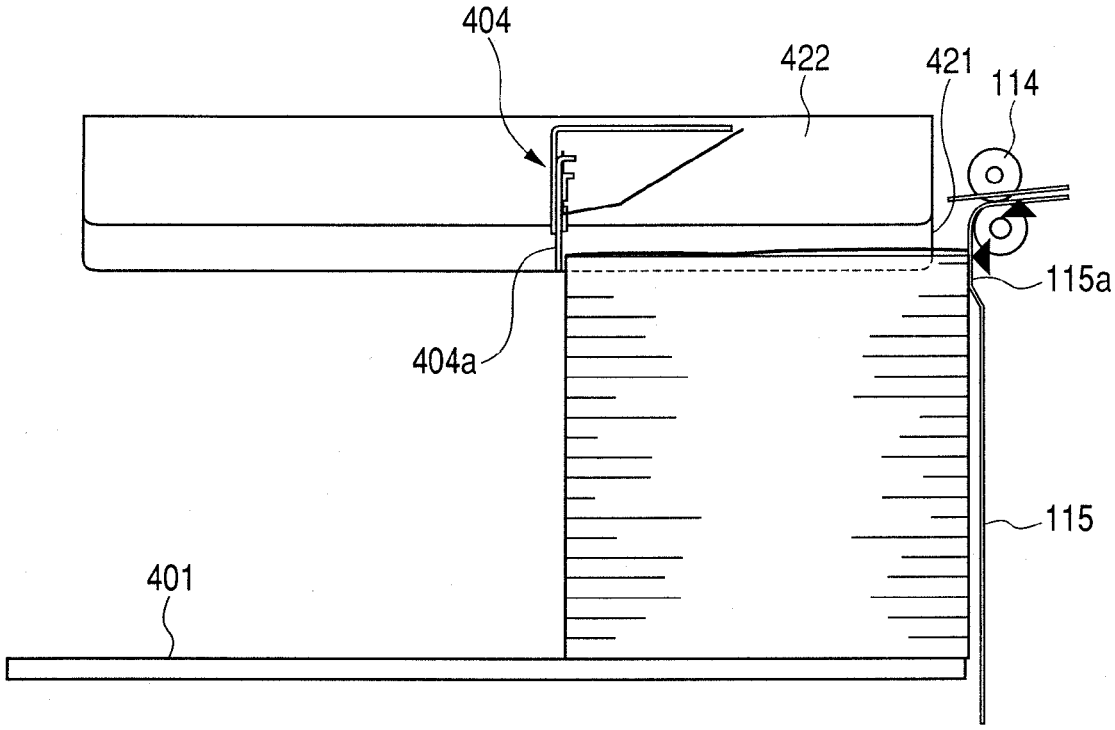
FIG. 13 is a diagram illustrating a state of the stacking portion when the above stacking tray is lowered.

As stacking progresses, as illustrated in FIG. 13, the leading edge plate 404*a* of the leading edge stopper 404, the second external plate 421 and the first internal plate 412 move away from the face of the stack tray 401. However, the leading edge plate 404*a* and the second external plate 421 can move downward by gravity within the sliding area as described earlier.

Therefore even if there is a small variation in the height position of the stacked sheet surface in the stack tray 401, it is possible to move securely the aligned sheets P downward together with the stack tray 401, keeping alignment of the sheets.

When the shift toward the second guide side is selected, the first and second rollers 306*a*, 307*a* illustrated in FIG. 4 are separated from the first and second oblique-feed rollers 304*a*, 305*a*. The third and fourth rollers 306*b*, 307*b* are brought into contact with the third and fourth oblique-feed rollers 304*b*, 305*b*. Further in the stacking portion 400, the internal plate (hereinafter referring to as the first internal plate) 412 of the first side stopper side of the first and second side stoppers 410, 420 is located in higher position for standby, and the second internal plate 422 is in a lower position for standby.

In the present embodiment, the aligning operations of the sheets P are not done simultaneously in both the sheet conveying direction and the width direction, but one direction is done at a time, thereby enabling the sheets to align with the aligning surface with ease and to correct skew of the sheets securely.

Furthermore, in the present embodiment as described above, the aligning operation by the first and second side stoppers 410, 420, which are disposed upstream of the leading edge stopper 404 in the sheet conveying direction, is arranged to be performed earlier, and the aligning operation by the leading edge stopper 404 is performed afterwards.

The aligning operation by the first and second side stoppers 410, 420 is performed earlier as described above, thereby the first and second side stoppers 410, 420 can be moved to standby position before the subsequent sheet is discharged to the stack tray 401.

In addition, in the present embodiment, the first and second side stoppers 410, 420 are arranged to move in a direction away from the sheet before the aligning operation by the leading edge stopper 404 is completed.

Figure 18:
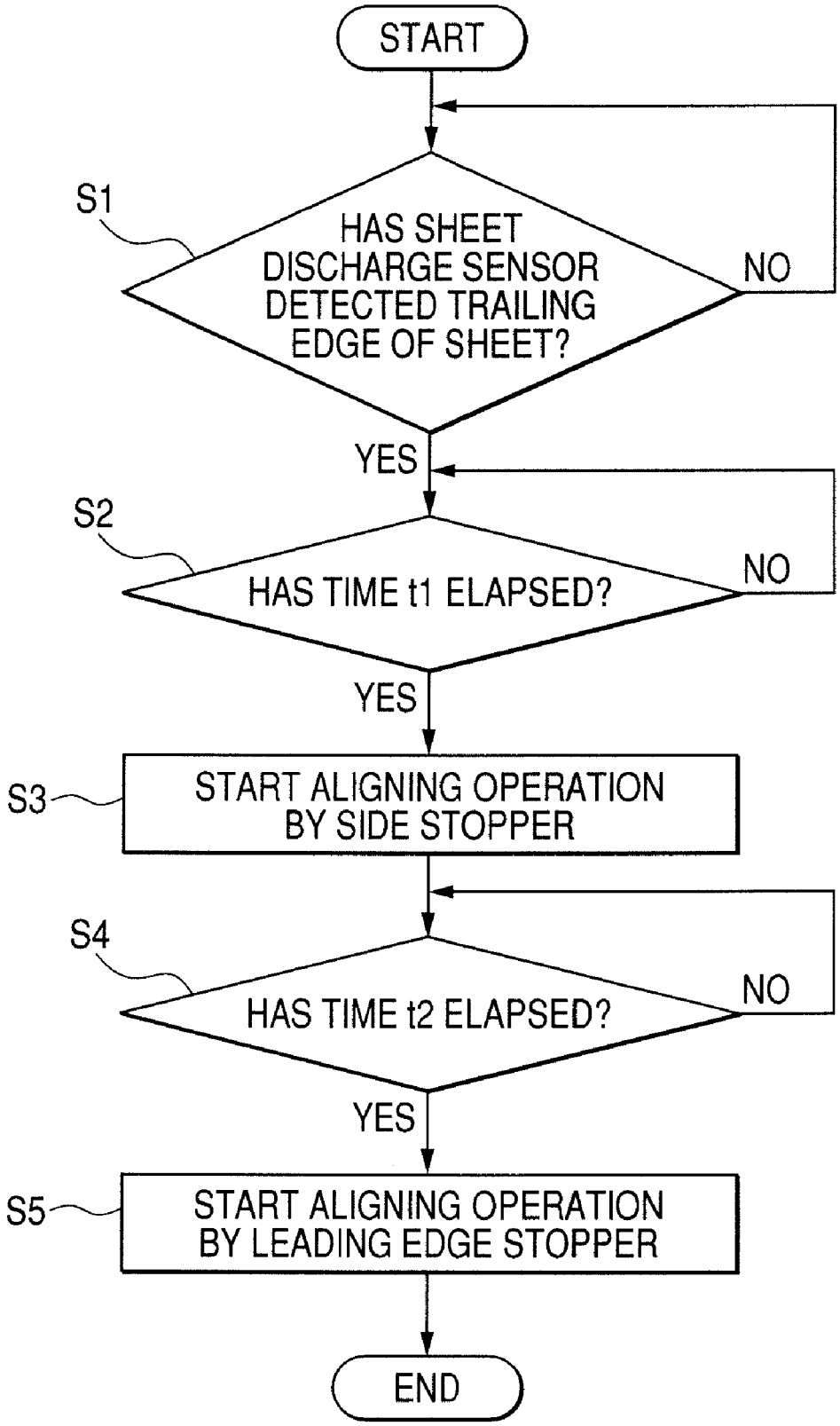
FIG. 18 is a flowchart of a control according to an aligning operation by a leading edge stopper and a side stopper.

A flowchart according to the aligning operation between the first and second side stoppers 410 and 420 and the leading edge stopper 404 is illustrated in FIG. 18. As illustrated in FIG. 18, the stacker controlling portion 210, based on a signal from the sheet discharging sensor 116, determines whether or not the trailing edge of the sheet has passed the position of the sheet discharging sensor 116 (S1). The stacker controlling portion 210 makes such a control as to start the aligning operation by the first and second side stoppers 410 and 420 after a first predetermined time period t1 has elapsed after the detection of the sheet trailing edge by the sheet discharging sensor 116 (S2, S3). In addition, the stacker controlling portion 210 makes a control so as to start the aligning operation by the leading edge stopper 404 after a second predetermined time period t2 has elapsed after the detection of the sheet trailing edge by the sheet discharging sensor 116 (S4, S5).

Figure 19:
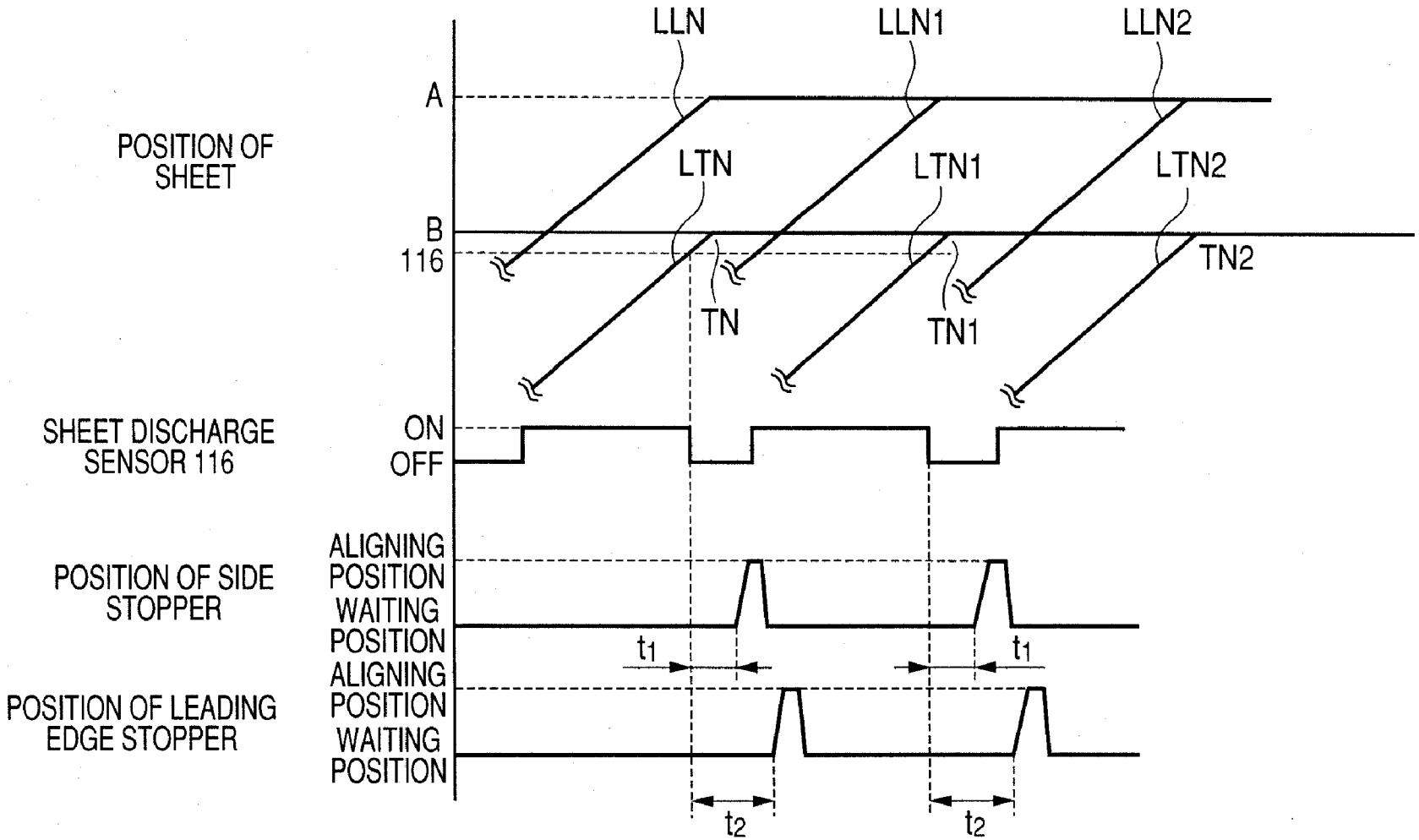
FIG. 19 is a chart illustrating the relationship between the aligning operation by the leading edge stopper and the side stopper, and a conveying position of the sheet.

FIG. 19 is a chart for explaining the relationship between the aligning operation by the first and second side stoppers 410 and 420 and the leading edge stopper 404, and the conveying position of a sheet to be discharged. LLN indicates a location of a leading edge of the Nth sheet, and LTN indicates a location of a trailing edge of the Nth sheet. As to the position of the sheet, the axis of ordinates indicates the position in the sheet discharging direction (in the conveying direction); and A indicates the standby position of the leading edge stopper, and B indicates the position of the abutting surface 115*a* of the trailing edge guide 115 (refer to FIG. 11). Reference numeral 116 indicates the position of the discharge sensor 116. Incidentally, LLN1 indicates the location of the leading edge of the N+1th sheet, and LTN1 indicates the location of the trailing edge of the N+1th sheet respectively. LLN2 indicates the location of the leading edge of the N+2th sheet, and LTN2 indicates the location of the trailing edge of the N+2th sheet respectively.

When the leading edge of the sheet to be discharged by the discharge roller 114 has passed the sheet discharging sensor 116, the signal of the sheet discharging sensor 116 is switched from OFF to ON. When the trailing edge of the sheet to be discharged by the discharge roller 114 has passed the sheet discharging sensor 116, the signal of the sheet discharging sensor 116 is switched from ON to OFF. At time TN, TN1, TN2, the leading edge of the sheet is positioned at the standby position A of the leading edge stopper, and the trailing edge of the sheet is positioned in the position B of the abutting surface 115*a* of the trailing edge guide 115. Thus, the time points TN, TN1, and TN2 indicate respective time points at each of which the sheet is discharged onto the stack tray 401 by the sheet discharge roller 114, and the sheet has been stacked on the stack tray 401.

After the first predetermined time period t1 has elapsed since the tailing edge of the Nth sheet being passed through the sheet discharging sensor 116, that is the output from the sheet discharging sensor 116 is switched from ON to OFF, the first and second side stoppers 410 and 420 start to move from the standby position to the aligning position. After the second predetermined time period t2 has elapsed since the trailing edge of the Nth sheet being passed through the sheet discharging sensor 116, the leading edge stopper 404 starts to move from the standby position to the aligning position.

While the leading edge stopper 404 is moved from the standby position to the aligning position in order to align the Nth sheet, and returned from the aligning position to the standby position, the N+1th sheet to be discharged subsequently to the Nth sheet is conveyed on the stack tray 401 by the discharge roller 114. That is, when the leading edge stopper 404 is moved for aligning the sheet, the N+1th sheet is conveyed by the discharge roller 114 such that the leading edge thereof has passed already the position of the abutting surface 115*a* of the trailing edge guide 115. With the arrangement, while the leading edge stopper 404 is being moved for aligning the sheet, since the subsequent sheet can be conveyed by the discharge roller 114 on the stack tray 401, the time interval between discharging successive sheets can be made shorter. Therefore, a discharge operation of a sheet can be conducted at high speed while a good alignment is being done.

To prevent the leading edge of the subsequent sheet from reaching the position of the first and second side stoppers 410 and 420 before the first and second side stoppers 410 and 420 are returned to the standby position, the between sheet time interval and the timing of the aligning operation of the first and second side stoppers 410 and 420 are set. In addition, the between sheet time interval and the timing of the aligning operation of the leading edge stopper 404 are set such that the leading edge of the subsequent sheet reaches the standby position of the leading edge stopper 404 after the leading edge stopper 404 has returned to the standby position.

By moving the first and second side stoppers 410 and 420 in this way, the next sheet is discharged onto the stack tray 401 at a time such that it does not collide with the leading edge stopper 404 whilst it is positioned in the aligning position. Moreover, during the aligning operation by the leading edge stopper 404, the discharge operation of the next sheet by the discharge roller 114 is started. In addition, since the first and second side stoppers 410 and 420 have been returned to the standby position already on the occasion of a conveying operation by the discharge roller 114, the next sheet being conveyed for discharge does not collide with the first and second side stoppers 410 and 420. Furthermore, before the discharge of the next sheet by the discharge roller 114 has been completed, and thus the next sheet is stacked on the stack tray 401, the leading edge stopper 404 has been moved back to the standby position.

Because the aligning operation is not made simultaneously with respect to both the sheet conveying direction and the width direction, but is done sequentially, it makes the sheet easy to align with the aligning surface, thus providing reliable alignment. A discharge interval of the sheet P onto the stack tray 401 can be made shorter, and the sheet P can be stably stacked at high speed as well as with high accuracy.

Incidentally, the timing in which after the first and second side stoppers 410 and 420 have returned to the standby position, the leading edge stopper 404 starts to move form the standby position to the aligning position is illustrated by example in the above-mentioned descriptions. However, while the first and second side stoppers 410 and 420 are being moved from the aligning position to the standby position, the leading edge stopper 404 may start to move from the standby position to the aligning position.

As described so far, the first and second side stoppers 410 and 420 are arranged to move in the direction away from the sheet after the sheet aligning but before the aligning operation by the leading edge stopper 404 is completed, and thereby the "between sheet" interval can be shortened. With the arrangement, the sheets can be stacked steadily at high speed and with high precision. Owing to this, it is possible to cope with an image forming apparatus 900 which has shorter between sheet time intervals and further higher productivity.

Next, the sheet stacking operation in the shift mode will be described.

When the shift mode is selected, for example, in order to shift the initial sheet bundle to be stacked in the stack tray 401 to the first guide side, the sheets are stacked to the sheet tray 401 following the same action with the stacking action for the shiftless mode as described earlier.

Next, when the subsequent sheet bundle is shifted to the second guide side to be stacked on that side, immediately after the last sheet of the previous sheet bundle passes, the first and second rollers 306*a*, 307*a*, illustrated in FIG. 4 are separated from the first and second oblique-feed rollers 304*a*, 305*a*. At the same time the third and fourth rollers 306*b*, 307*b* are brought into contact with the third and fourth oblique-feed rollers 304*b*, 305*b*.

Figure 14:
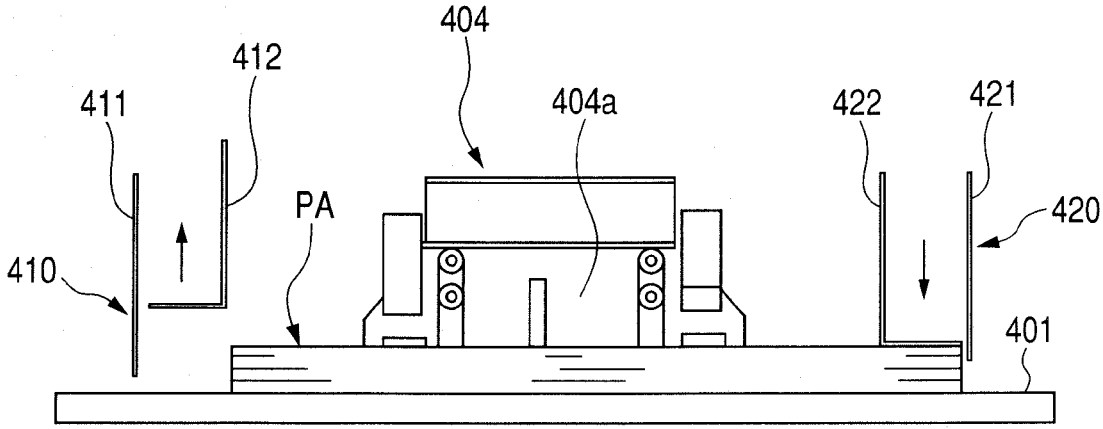
FIG. 14 is a first diagram illustrating a sheet stacking operation when a shift mode of the above stacking portion is selected.

In the stacking portion 400, as illustrated in FIG. 14, the first and second internal plates 412, 422 of the first and second side stoppers 410, 420 are arranged to be in a higher position and a lower position respectively for standby by changing over. On this occasion, the second internal plate 422, which has moved to the lower position, is laid on the sheet bundle PA shifted to the first guide side and stacked on that side.

Next, after the first and second guides 301, 302, and the first and second side stoppers 410, 420 move to the standby positions (initial positions), the sheets are conveyed to the grouping portion 300 by the conveying roller 112.

Figure 15:
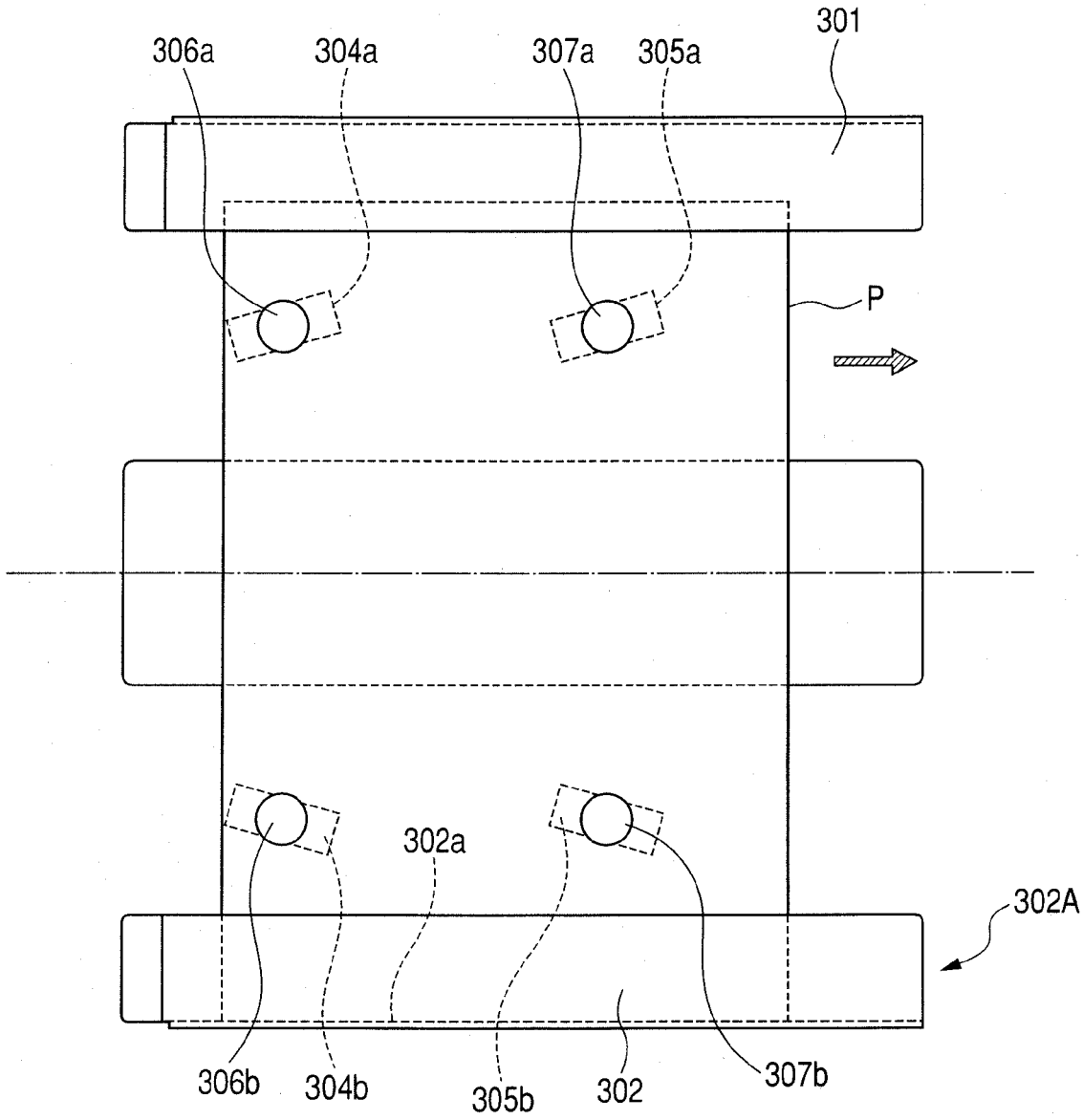
FIG. 15 is a diagram illustrating a state when the shift mode of the above grouping portion is selected.

In the grouping portion 300, as illustrated in FIG. 15, the sheet P is nipped for oblique-feed by the third and fourth oblique-feed rollers 304*b*, 305*b* and the third and fourth rollers 306*b*, 307*b*, thereafter the sheet abuts on the abutting surface 302*a* of the guide portion 302A of the second guide side. Thereby, the skew feed and the width direction position are corrected and the sheet P is conveyed with reference to the abutting surface 302*a*.

Figure 16:
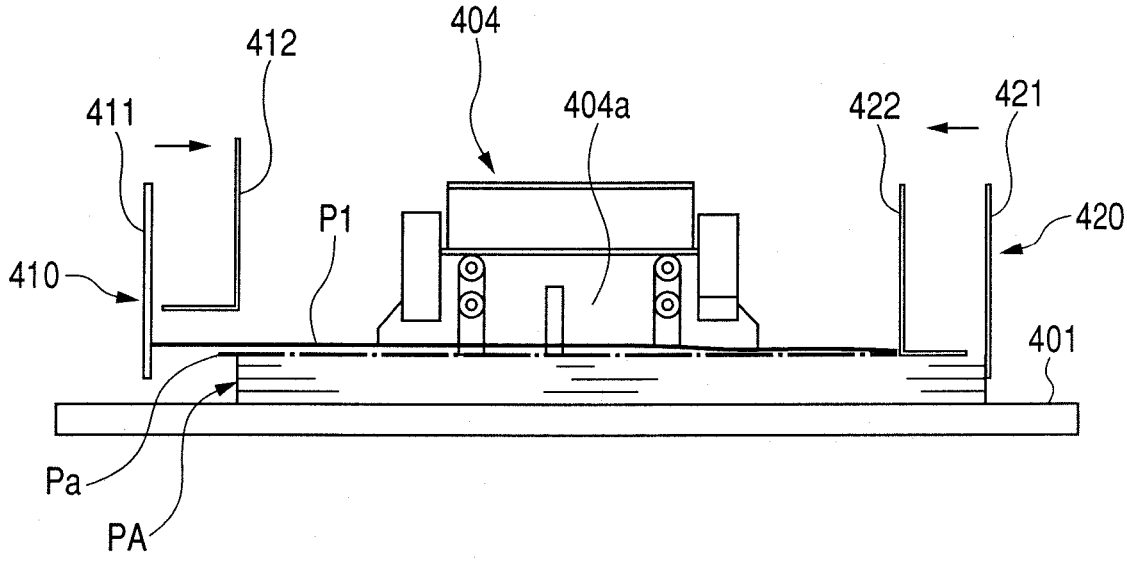
FIG. 16 is a diagram illustrating a malfunction when a shift mode of the above stacking portion is selected.

Thereafter, the sheet P1 discharged by the discharging roller 114, as illustrated in FIG. 16, enters between the first external plate 411 and the second internal plate 422 to be stacked on the sheet bundle PA, and is stacked on the second guide side.

At that time, the leading edge plate 404*a* of the leading edge stopper 404 and the second external plate 421 abut on the side surfaces of the sheet bundle PA, and the second internal plate 422 abuts on the top surface of the sheet bundle PA. Therefore the leading edge of the discharged sheet P1 is stopped by the leading edge plate 404*a* of the leading edge stopper 404.

Thereby, when the sheets are discharged to the stack tray 401, the sheets are surrounded by the first external plate 411 and the second internal plate 422 for the side edges of the sheets P1, and by the leading edge plate 404*a* of the leading edge stopper 404 and the abutting surface 115*a* of the trailing edge guide 115 for the leading and trailing edges of the sheets P1 in the sheet discharging direction.

On this occasion the second internal plate 422 is laid on the already-stacked sheet bundle. Therefore, thereafter, when the aligning operation is performed by the first and second side stoppers 410, 420 as described above, the second internal plate 422 slides on the already-stacked sheet bundle and the uppermost sheet Pa of the already-stacked sheet bundle PA is fed together in association with the slide of the second internal plate 422 as illustrated in FIG. 16, resulting in disordering the sheet P alignment.

Since the moving distance of the first and second side stoppers 410, 420 is 2 mm, one aligning operation may deviate the uppermost sheet Pa (hereinafter referring to as the already-stacked uppermost sheet) in the already-stacked sheet bundle PA by 2 mm in the worst case. Then, repeated aligning operations increase the deviation amount.

In order to avoid such misalignment, the aligning operation in the width direction is performed collectively for a predetermined number of stacked sheets, before the second internal plate 422 is separated from the uppermost sheet Pa of the already-stacked sheets due to the descent of the stack tray 401 accompanied with stacking of the sheets P1. Note that, in the present embodiment, the predetermined number of the stacked sheets is 20, and as the number of the stacked sheets increases, the stack tray 401 descends accordingly. Accompanying this, the number of sheets at which the second internal plate 422 is separated from the uppermost sheet Pa of the stacked sheets is set to be 40 as described above.

In other words, in the present embodiment, the aligning operation by the first and second side stoppers 410, 420 is performed collectively once each time 20 sheets are stacked in the stack tray 401. In addition, after the stack tray 401, in which 40 sheets have been stacked, descends and the second internal plate 422 is separated from the uppermost sheet Pa on the already-stacked sheets, the aligning operation is performed for every sheet discharged.

According to such arrangement, the sheets shifted to the second guide side and discharged to the stack tray 401 are aligned in the sheet conveying direction one at a time up to 19 sheets only by the aligning operation of the leading edge stopper 404. During this time, the first and second side stoppers 410, 420 stand still at the standby position.

Figure 17A:
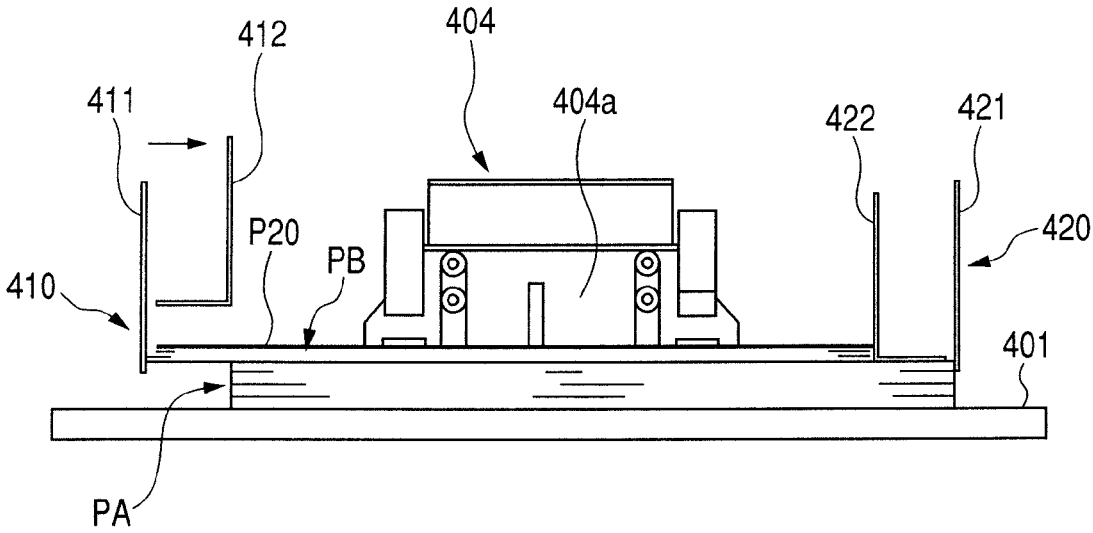
FIGS. 17A and 17B are second diagrams illustrating a sheet stacking operation when a shift mode of the above stacking portion is selected.

As illustrated in FIG. 17A, when the 20th sheet is discharged, the first and second side stoppers 410, 420 move toward one another (getting closer to the sheet) by 2 mm respectively, actuated by the motor 432. Thereby, the distance between the first external plate 411 and the second internal plate 422 becomes equal to the width of the sheet P, hence the aligning operation in the width direction can be performed collectively for the sheet bundle PB of the discharged 20 sheets.

After the aligning operation of the sheet bundle PB in the width direction, the first and second side stoppers 410, 420 move to the standby position having 2 mm widened position again to be ready for the next discharged sheet. Thereafter, the aligning operation for the sheet conveying direction of the sheet bundle PB by the leading edge stopper 404 as described above is performed.

Figure 17B:
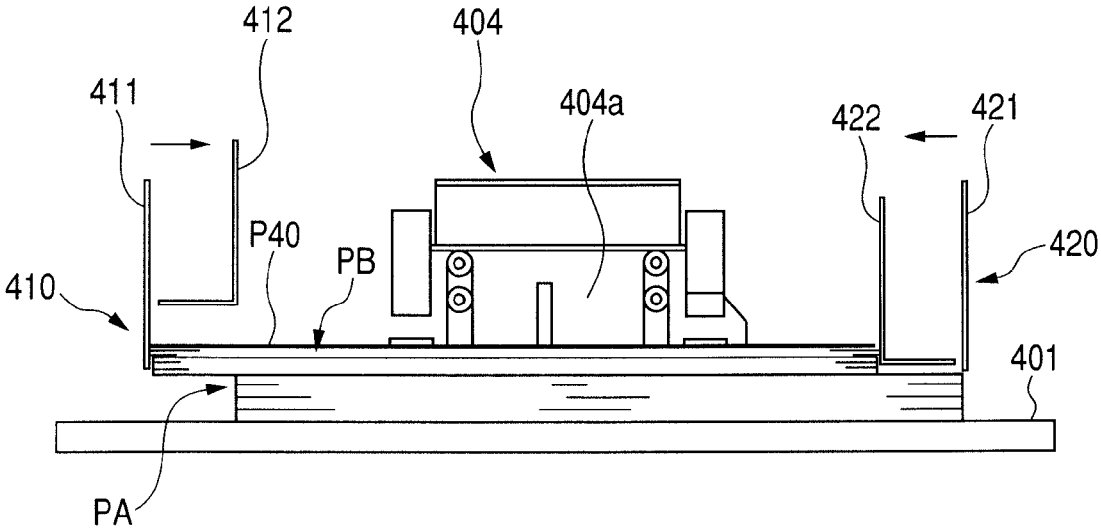

Such a collective aligning operation is also applied for the subsequent 20 sheets to be discharged, and the 40th sheet P40 is stacked in due course as illustrated in FIG. 17B. Since the number of stacked sheets is 40 at which the second internal plate 422 is separated from the uppermost sheet Pa of the already-stacked sheets, and thus when the 40th sheet P40 is stacked and the stack tray 401 descends, the second internal plate 422 is separated from the uppermost sheet Pa of the already-stacked sheets.

After the second internal plate 422 is separated from the uppermost sheet Pa of the already-stacked sheets, even in a case where the aligning operation by the first and second side stoppers 410, 420 is performed, the second internal plate 422 never feeds together the uppermost sheet Pa of the already-stacked sheets in association with the slide of the second internal plate 422.

When the sheet P from the 41st onwards is discharged, the aligning operation by the first and second side stoppers 410, 420 and the leading edge stopper 404 is performed at for each sheet discharged, just like the case of the 20th sheet and the 40th sheet, since the second internal plate 422 has been separated from the uppermost sheet Pa of the already-stacked sheets.

Also, the last sheet in a case where the number of sheets in the sheet bundle PB is not more than 40, is stacked through an aligning operation by the first and second side stoppers 410, 420 and the leading edge stopper 404.

When stacking with a shift to the second guide side is completed, and there are still sheet bundles to be stacked, stacking is continued through changing to the stacking with a shift to the first guide side again. In this case again, the first and second side stoppers 410, 420 perform the aligning operation in bundles of each 20 sheets up to the first 40 sheets. Such operations as described above are repeated up to the final bundle to stack the required number of sheets in the stack tray 401.

When such a configuration as described above is adopted, the number of times the uppermost sheet Pa in the already-stacked sheets is fed together with the aligning operation by the first and second side stoppers 410, 420 is one time only, and the deviation amount thereof is suppressed down to 2 mm or less, which gives in general no practical problems.

As described above, when the internal plates 412, 422 slide on the top face of the already-stacked sheet bundle, the aligning operation is performed after a plurality of sheets has been stacked. Thereby, even when the sheet bundle is stacked with a displacement or shift, the sheets can be stacked steadily without disordering the alignment of the already-stacked sheet bundle.

It should be noted that the number of sheets to be aligned collectively within the range of 40 sheets or less may be altered appropriately depending on the aligning performance of the collective aligning process, and the deviation amount caused by the associated feed of the uppermost sheet Pa in the already-stacked sheets. In general, the larger the number of sheets to be collectively aligned, the less deviation to the top most sheet of the underlying bundle of sheets is caused by the associated feed.

According to the description presented so far, after the second copy (bundle) onwards in the shift mode, the initial sheets up to 40 sheets are divided into a group of 20 sheets, and 20 sheets are aligned collectively so that the number of associated feedings is reduced so that less amount of deviation is obtained.

However, after the second copy (bundle) onwards in the shift mode, it may be arranged so that no aligning operation is performed up to 40 sheets. In other words, when the number of the subsequent bundle to be stacked is less than or equal to 40, the aligning operation may be performed after all sheets for the subsequent bundle are discharged. In this case, the distance between the external plates 411, 421 of the first and second side stoppers 410, 420 and the opposing internal plates 412, 422 is wider than the sheet size by 2 mm each, which is 4 mm in total.

Therefore, in this case the sheets may have deviation of this amount as maximum (within 4 mm) on the stack tray. However, it is better that the first and second side stoppers 410, 420 align the sheets after all sheets are discharged on the stack tray than the first and second side stoppers 410, 420 align sheets every time a sheet is stacked on the stack tray 401. Because the deviation caused by the associated feed may be produced largely beyond 4 mm through moving the first and second side stoppers 410, 420 every time a sheet is stacked on the stack tray 401.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2006-297134, filed Oct. 31, 2006, which is hereby incorporated by reference herein in its entirety.

What is claimed is:

1. A sheet stacking apparatus comprising:

a sheet stacking portion on which sheets are stacked;

a sheet conveying portion which conveys the sheets to discharge the sheets successively onto the sheet stacking portion;

a first aligning member which aligns a position of a downstream edge in a sheet conveying direction of a sheet stacked on the sheet stacking portion by a movement of the first aligning member from a standby position to an aligning position along the sheet conveying direction of the sheet conveying portion;

a second aligning member which aligns a position in a width direction of the sheet stacked on the sheet stacking portion by a movement of the second aligning member from a standby position to an aligning position in the width direction crossing the sheet conveying direction; and a controller for controlling said sheet stacking apparatus, wherein said controller controls said sheet stacking apparatus so that when sheets conveyed by the sheet conveying portion are successively discharged onto the sheet stacking portion, an aligning operation in which an uppermost sheet of the sheets discharged onto the sheet stacking portion is aligned first by the second aligning member and aligned second by the first aligning member is performed with the stacking of each sheet, and said controller controls said sheet stacking apparatus so that after the second aligning member, which has been moved to the aligning position to align the uppermost sheet, is returned to the standby position and during the movement of the first aligning member between the standby position and the aligning position to align the uppermost sheet, the sheet conveying portion conveys a next sheet to discharge the next sheet onto the sheet stacking portion.

2. A sheet stacking apparatus according to claim 1, wherein the sheet stacking portion is moveable such that the sheet stacking portion can be lifted and lowered;

the first aligning member is constructed to contact the downstream edge of the sheet, as well as to be lowered as the sheet stacking portion is lowered; and the second aligning member is constructed to contact the sheet to align the sheet, as well as to be lowered as the sheet stacking portion is lowered.

3. A sheet stacking apparatus according to claim 1, wherein after the second aligning member starts to move from the aligning position for aligning the uppermost sheet to the standby position, the first aligning member is positioned in the aligning position for aligning the sheet.

4. An image forming apparatus comprising:

an image forming portion forming an image on a sheet; and a sheet stacking apparatus according to claim 1, the sheet stacking apparatus stacking the sheet on which the image is formed by the image forming portion.

5. A sheet stacking apparatus according to claim 1, wherein each of the first and second aligning members is reciprocated to align an uppermost sheet every time the sheet conveying portion discharges a sheet to the sheet stacking portion.

6. A sheet stacking apparatus according to claim 1, wherein after the second aligning member which has been moved to the aligning position to align the uppermost sheet is returned to the standby position, the first aligning member starts to move to align the uppermost sheet.

* * * * *